US012504260B2

(12) United States Patent
Arnold

(10) Patent No.: US 12,504,260 B2
(45) Date of Patent: Dec. 23, 2025

(54) CLAY TARGET THROWERS AND RELATED METHODS

(71) Applicant: Ferus Outdoors LLC, Huntersville, NC (US)

(72) Inventor: Greg Arnold, Huntersville, NC (US)

(73) Assignee: Ferus Outdoors LLC, Huntersville, NC (US)

( * ) Notice: Subject to any disclaimer, the term of this patent is extended or adjusted under 35 U.S.C. 154(b) by 0 days.

(21) Appl. No.: 18/424,822

(22) Filed: Jan. 28, 2024

(65) Prior Publication Data

US 2024/0167795 A1 May 23, 2024

Related U.S. Application Data

(62) Division of application No. 17/334,379, filed on May 28, 2021, now Pat. No. 11,920,908.

(60) Provisional application No. 63/114,294, filed on Nov. 16, 2020, provisional application No. 63/032,262, filed on May 29, 2020.

(51) Int. Cl.
*F41J 9/18* (2006.01)
*F41J 9/22* (2006.01)

(52) U.S. Cl.
CPC .. *F41J 9/22* (2013.01); *F41J 9/18* (2013.01)

(58) Field of Classification Search
CPC ..... F41J 9/18; F41J 9/20; F41J 9/22
See application file for complete search history.

(56) References Cited

U.S. PATENT DOCUMENTS 313,804 A * 3/1885 Bloom ..... F41J 9/20 124/8
624,044 A * 5/1899 Jenkins ..... F41J 9/20 124/47
683,308 A * 9/1901 Lord ..... F41J 9/18 124/47
762,353 A * 6/1904 Schulte ..... A63B 69/406 124/43
3,601,112 A * 8/1971 Dale ..... F41J 9/20 124/80
3,612,025 A * 10/1971 Rhodes ..... F41J 9/32 124/36
4,014,310 A * 3/1977 Laporte ..... F41J 9/18 280/38
4,481,932 A * 11/1984 Olson ..... F41J 9/20 124/43
4,831,996 A * 5/1989 Cero ..... F41J 9/24 74/2
4,976,249 A * 12/1990 Gagnon ..... F41J 9/22 124/36
5,014,677 A * 5/1991 Gagnon, Sr. ..... F41J 9/18 124/4

(Continued)

*Primary Examiner* — John A Ricci
(74) *Attorney, Agent, or Firm* — Kirby Drake

(57) ABSTRACT

A device for launching at least one clay target, the device includes a clay target thrower, at least three legs, a first leg coupled to the clay target thrower, a movable second leg coupled to the clay target thrower, and a movable third leg coupled to the clay target thrower. The movable second leg is configurable into an operational position and into a folded position. The movable third leg is configurable into an operational position and into a folded position. The folded positions of the movable second leg and the movable third leg facilitate transport and storage of the device.

6 Claims, 21 Drawing Sheets

(56) References Cited

U.S. PATENT DOCUMENTS 5,226,622 A * 7/1993 LeAnna ..... F16M 13/02 248/219.2
5,427,380 A * 6/1995 Hazard ..... F41J 9/18 273/362
5,470,078 A * 11/1995 Conlan ..... F41J 9/18 273/362
5,720,664 A * 2/1998 Brubacher ..... F41A 33/02 273/362
5,857,451 A * 1/1999 Ciluffo ..... F41B 3/04 124/6
6,159,112 A * 12/2000 Ciluffo ..... A63B 69/0026 124/4
7,263,986 B2 * 9/2007 Lovell ..... F41J 9/30 124/9
8,276,573 B2 * 10/2012 Skell ..... F41A 19/01 340/540
8,677,983 B2 * 3/2014 Callander ..... F41J 5/18 124/8
8,919,331 B2 * 12/2014 Rennert ..... F41J 9/18 124/1
8,943,945 B1 * 2/2015 Collins ..... F41J 9/20 124/16
9,839,050 B2 * 12/2017 Zhou ..... H04W 8/005
10,215,542 B2 * 2/2019 Schaller ..... F41J 9/165
10,518,159 B1 * 12/2019 Rosencrans ..... A63B 69/0002
10,746,513 B1 * 8/2020 Liu ..... F41J 9/24
11,137,233 B1 * 10/2021 Liu ..... F41J 9/30
2007/0023022 A1 * 2/2007 Lentz ..... F41J 9/22 124/8
2012/0138034 A1 * 6/2012 Whidborne ..... F41J 9/18 124/8
2015/0204638 A1 * 7/2015 Frazier ..... F41J 9/24 124/6
2018/0180390 A1 * 6/2018 Muller ..... F41J 9/18

* cited by examiner

CLAY TARGET THROWERS AND RELATED METHODS

CROSS-REFERENCE TO RELATED APPLICATIONS

This application is a divisional of U.S. patent application Ser. No. 17/334,379 filed May 28, 2021, now pending, which claims the benefit of United States provisional application No. 63/032,262, filed May 29, 2020 and 63/114,294, filed Nov. 16, 2020, the disclosures of which are incorporated herein by reference in their entirety.

TECHNICAL FIELD

Embodiments relate generally to devices and methods for launching target clays.

BACKGROUND

Clay target throwers are used by shooters and hunters for sport, competition, and to hone their shooting skills. Generally, clay target throwers are used in remote locations due to the space needed for target shooting. Currently clay target throwers are not easily transported to the remote locations used for shooting. Shooters typically bring one or more shotguns, ammunition, clay targets, food, and drink to these remote locations along with the clay target thrower adding to the transportation challenges. Additionally, when not in use, clay target throwers need to be stored, preferably in a fully assembled state, which usually requires a considerable amount of storage space.

Clay target throwers operate by an user rotating a throwing arm and this rotation of the throwing arm by the user tensions a large spring into a "cocked" state. A lever is operated by the user to release the throwing arm, which swings away from the user, throwing the target clay. Because the unit is free to continue to rotate, the throwing arm travels past 180-degrees after releasing clay, only to then rotate back the opposite direction, and so on, until it stops at the 180-degree free state position (no spring tension). When the user wants to cock the mechanism again, the user must rotate the throwing arm from its free state (no spring tension) back to its cocked state.

Certain clay target throwers are referred to as a ¾ cock, meaning the user does not have to rotate the throwing arm the full 180-degrees to return the throwing arm back to its cocked state. This is accomplished by a mechanism that stops the throwing arm from rotating in the opposite direction of the throwing direction. The throwing arm uses its rotating force to pre-load the spring, resulting in a 90-degree or less rotation requirement to return the throwing arm to a cocked state. The mechanism uses a combination of a gear, gear pawl, two rotation axes (gear and pawl), and a spring to stop the throwing arm from rotating back to its free state. The rotation of the throwing arm is subject to friction from the pawl, and the user experiences a ratcheting noise when cocking unit.

Current clay target throwers have smooth, flat bottoms for a base. When the thrower is fired, the spring energy referred to above may cause the thrower to twist or otherwise move which is undesirable, unless the thrower is somehow secured to prevent the movement.

Clay target throwers have a feature that allows the user to change the throwing angle of the target clay. This is accomplished by adjusting a fastener, such as a bolt or a nut, using a tool, such as wrench or a socket wrench. The tools for adjusting the throwing angle of the thrower are additional items that need to be transported to the remote location used for shooting.

Clay target throwers typically have a guide or rail, usually made with an elastic material, to guide the clay down the length of the throwing arm. Target clays vary in thickness according to the desired characteristics of the target. Standard (108 mm), Midi (90 mm), Battue, and Rabbit are standard clays used in throwers. To accommodate these varying thicknesses, the guide or rail needs to be adjusted to the correct height. This is accomplished by removing screws securing the guide or rail to the throwing arm, repositioning the guide to another set of mounting holes, and reinstalling the screws. The tools for adjusting the guide or rail are additional items that need to be transported to the remote location used for shooting.

Accordingly, the present disclosure contemplates that there is a need for improved clay target throwers.

SUMMARY

Generally, a device for launching at least one clay target is provided and comprises a clay target thrower coupled to at least three legs, a first leg, a movable second leg configurable into an operational position and into a folded position, and a movable third leg configurable into an operational position and into a folded position. One or more of the respective couplings between the thrower and the legs may be direct or indirect. For example, a base may be located between the legs and the thrower, thereby making the couplings indirect. The device may further comprise a manner of allowing movement of the second and third legs without the necessity of using tools. For example, at least one of a lever, a knob, a bolt, a nut, a pin, and a detent may be provided to configure the movable second leg and the movable third leg into the operational position and into the folded position without using tools.

In alternative or additional aspects, the device may further comprise a base connecting the clay target thrower to the legs. The device may further comprise a movable thrower mount. The clay target thrower may be coupled to the movable thrower mount, the movable thrower mount may be coupled to a base, and the base may be coupled to the legs. The thrower mount may allow the clay target thrower to be configured into an operational position and into a folded position. The device may further comprise a manner of allowing movement of the clay target thrower to be configured into an operational position and into a folded position without the necessity of using tools. For example, at least one of a lever, a knob, a bolt, a nut, a pin, and a detent may be provided to allow a user to configure the clay target thrower into the operational position and into the folded position without using tools.

In alternative or additional aspects, the legs of the device may include at least one of a tab and a spike to engage the surface the device is placed upon to prevent movement of the device during operation.

In some embodiments, a device for launching at least one clay target may comprise a clay target thrower and a release mechanism and the release mechanism may be coupled to the clay target thrower. The release mechanism may comprise a lockout which must be operated by a user concurrently with the release mechanism in order to launch the at least one clay target. In alternative or additional aspects, the release mechanism may comprise a release mechanism lock to prevent the operation of the release mechanism. When installed on the release mechanism, the release mechanism lock may prevent the operation of the release mechanism. The release mechanism lock may include at least one of a pin, a clip, a padlock, and a combination lock.

In some embodiments, a device for launching at least one clay target may comprise a clay target thrower, a throwing arm coupled to the clay target thrower, a vertical angle adjustment mechanism, and a base. The clay target thrower may be coupled to the vertical angle adjustment mechanism and the vertical angle adjustment mechanism may be coupled to the base. In alternative or additional aspects, a user may be able to adjust the vertical angle of the throwing arm relative to the base without using tools. For example, the vertical angle adjustment mechanism may further comprise at least one of a lever, a knob, a bolt, a nut, a pin, and a detent allowing a user may be able to adjust the vertical angle of the throwing arm relative to the base without using tools. The vertical angle adjustment mechanism may further comprise one or more toothed surfaces which may allow for selective vertical adjustment of the throwing arm relative to the base.

In alternative embodiments, a device for launching at least one clay target may comprise a clay target thrower that includes at least two springs coupled to the clay target thrower, the at least two springs may be arranged to divide a force required for launching the at least one clay target. As an addition feature of the device, the springs may be adjustable.

In alternative embodiments, a device for launching at least one clay target may comprise a clay target thrower and a clay target guide coupled to the clay target thrower. The clay target guide may be configured by a user for different sizes of clay targets. The clay target thrower may further comprise mounting hardware coupling the clay target guide to the clay target thrower. The clay target thrower may further comprise at least one of a series of holes and slots. The at least one of a series of holes and slots may allow the clay target guide to be selectively configured without removing the mounting hardware. Additionally, in some embodiments the clay target guide may be configured by the user without using tools.

In alternative embodiments, a device for launching at least one clay target is provided and comprises a clay target thrower and at least two wheels coupled directly or indirectly to the clay target thrower for transporting the device. The device may further comprise a seat for a user coupled directly or indirectly to the clay target thrower. The seat for a user may be used to transport at least one of an ice chest, a clay target box, a gun case, and an ammunition box, as non-limiting examples. The device may further comprise at least one handle coupled directly or indirectly to the clay target thrower for transporting the device. The device may include a base assembly comprising a base and at least three legs, and at least one of the at least three legs may be movable for transport. The at least one of the at least three legs may further include at least one of a lever, a knob, a bolt, a nut, a pin, and a detent and the at least one of the at least three legs may be movable for transport without using tools.

In alternative embodiments, a device for launching at least one clay target may include adjusting a horizontal throwing angle of a throwing arm relative to a base. Adjusting the horizontal throwing angle of the throwing arm may further comprise using at least one of a lever, a knob, a bolt, a nut, a pin, and a detent or other components/mechanisms, in order to allow a user to adjust the horizontal throwing angle without using tools.

In some embodiments, a device for launching at least one clay target may comprise a clay target thrower and a bottle opener.

Additional aspects and advantages of the invention will become more apparent upon further review of the detailed description of the illustrative embodiments taken in conjunction with the accompanying drawings.

DETAILED DESCRIPTION

Figure 1:
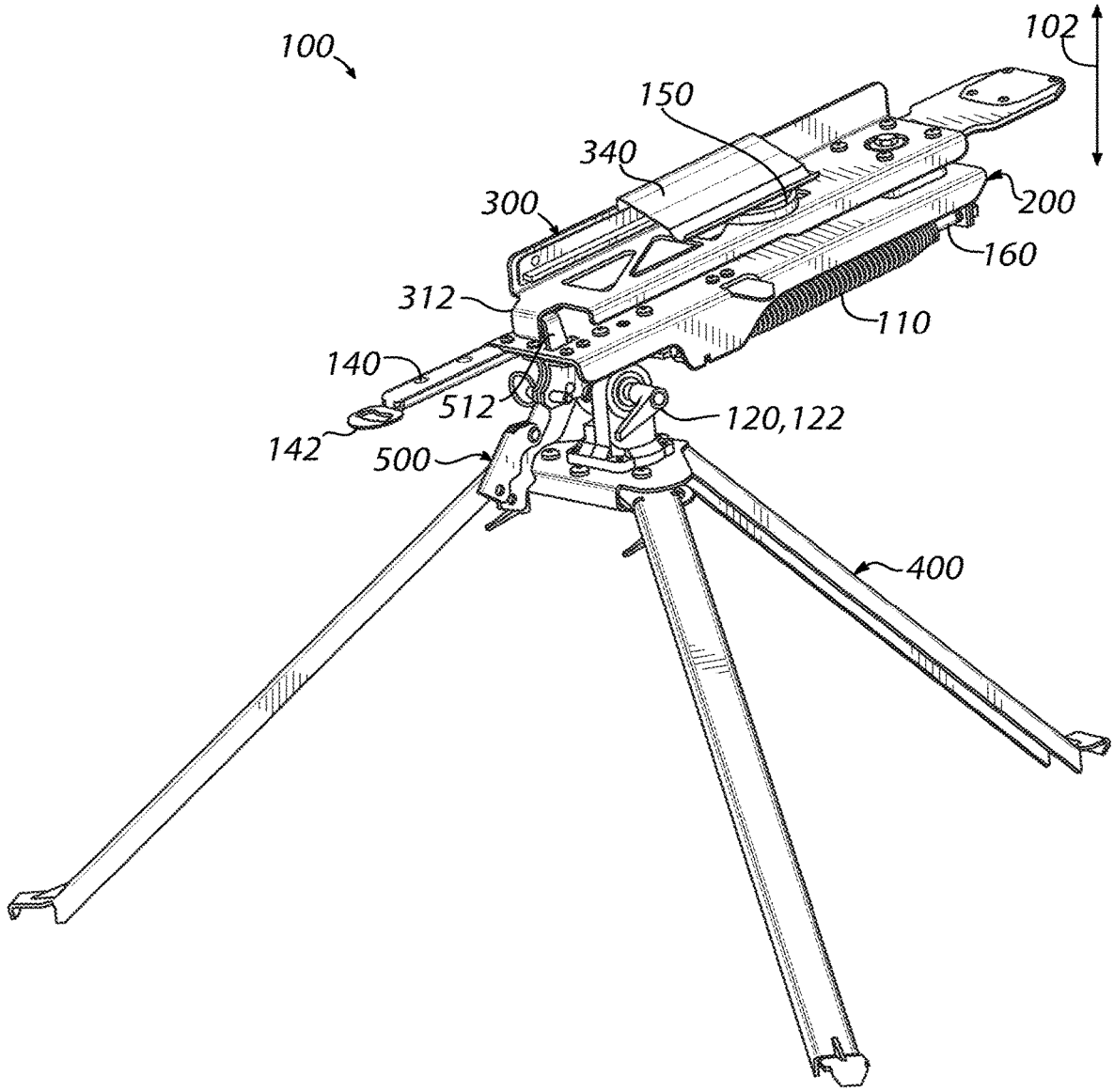
FIG. 1 is a perspective view of an illustrative clay target thrower.
Figure 2:
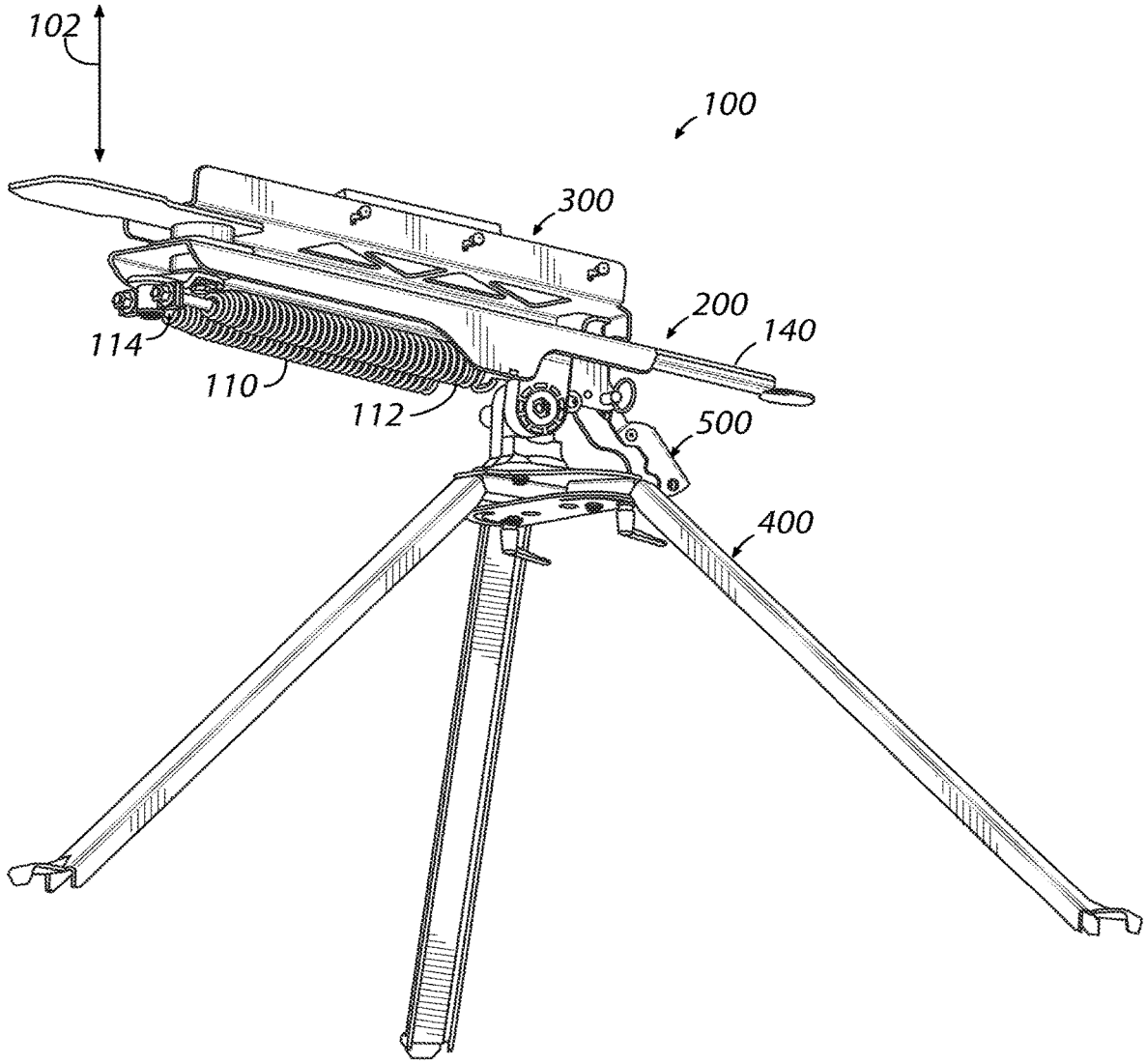
FIG. 2 is an alternate perspective view of an illustrative clay target thrower.

Referring to FIGS. 1 and 2, an illustrative clay target thrower 100 comprises a support arm assembly 200, a throwing arm assembly 300, a base assembly 400, and a trigger assembly 500. The illustrative clay target thrower 100 further comprises two springs 110, a pivot mount adjustment lever 120, and a handle 140 with a bottle opener 142. The clay target thrower 100 may be operated by a user to launch one or more target clays 150. As used herein to describe various embodiments from the perspective of a user of a clay target thrower, "proximal" may refer to a direction generally towards the user of the device, while "distal" may refer to a direction generally away from the user of the device. The trigger assembly 500 and the handle 140 are generally where a user would be located to operate the clay target thrower 100.

Figure 3:
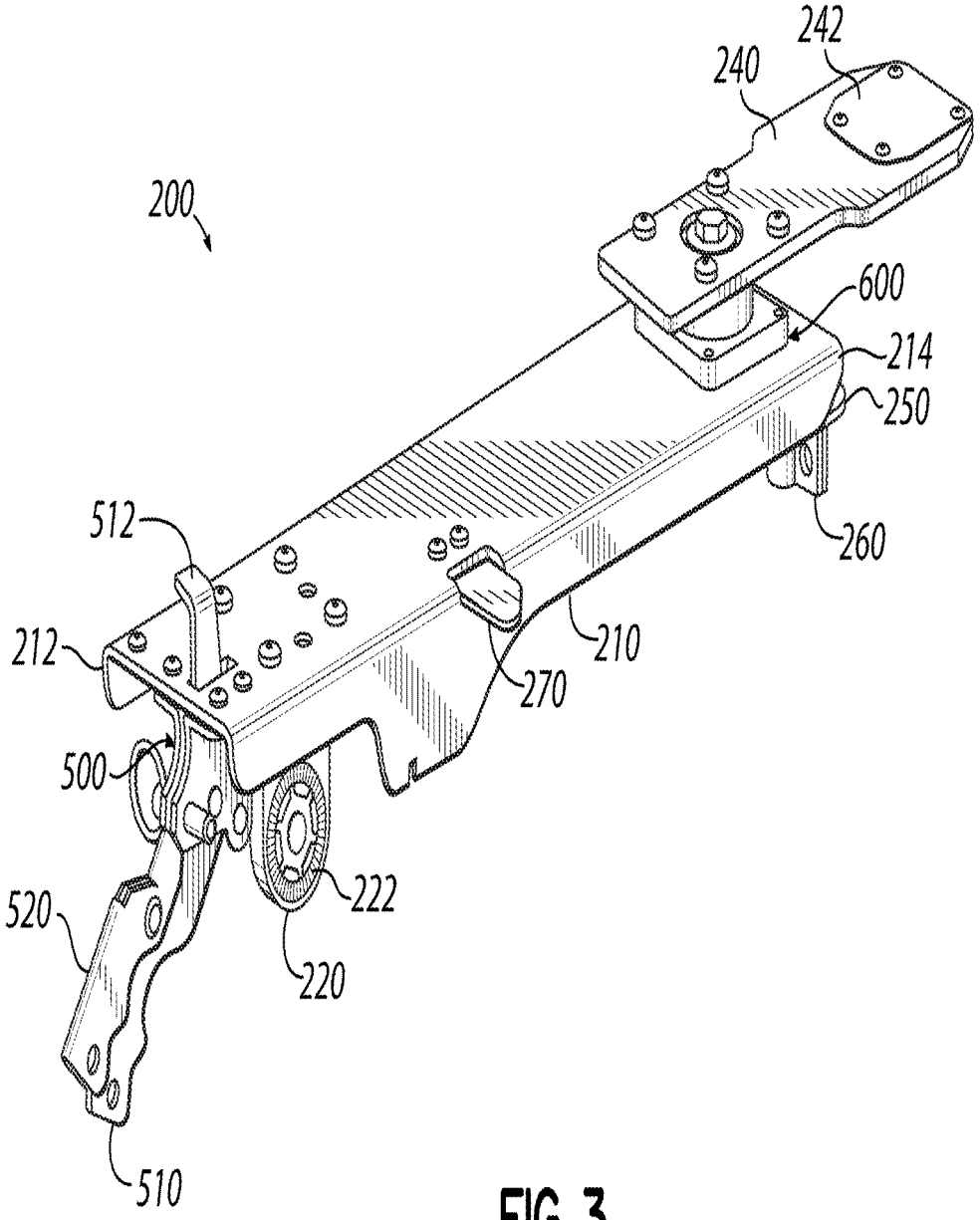
FIG. 3 is a detailed, side/top view of an illustrative support arm assembly.
Figure 4:
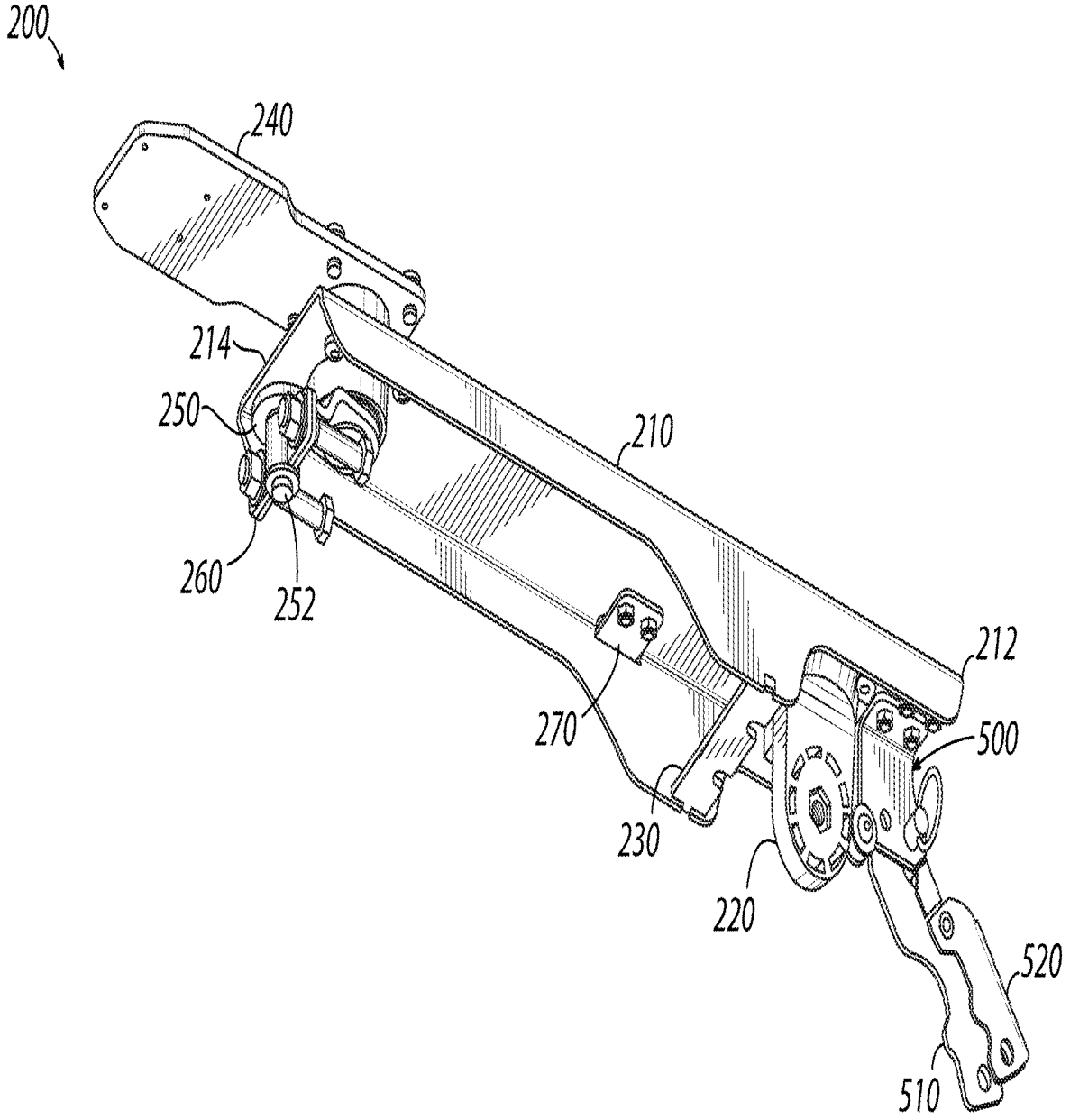
FIG. 4 is a detailed, side/bottom view of an illustrative support arm assembly.

Referring to FIGS. 3 and 4, the illustrative support arm assembly 200 comprises a support arm 210, a support arm pivot mount 220, a spring retainer plate 230, a counterweight 240, and a bearing assembly 600. The support arm assembly further comprises a lower bearing bracket 250, a spring retainer bracket 260, and a rabbit plate 270. As illustrated herein, the support arm 210 has a proximal end 212 and a distal end 214. The support arm pivot mount 220 is located on the bottom of the support arm 210 near the proximal end 212 of the support arm 210. The trigger assembly 500 is located near the proximal end 212 of the support arm 210, proximate to the support arm pivot mount 220. The counterweight 240 and the bearing assembly 600 are located proximate to the distal end 214 of the support arm 210. A badge plate 242 may be secured to the counterweight 240. The badge plate 242 may include a manufacturer's trademark, trade dress, and/or some other decoration or embellishment, for example.

Figure 5:
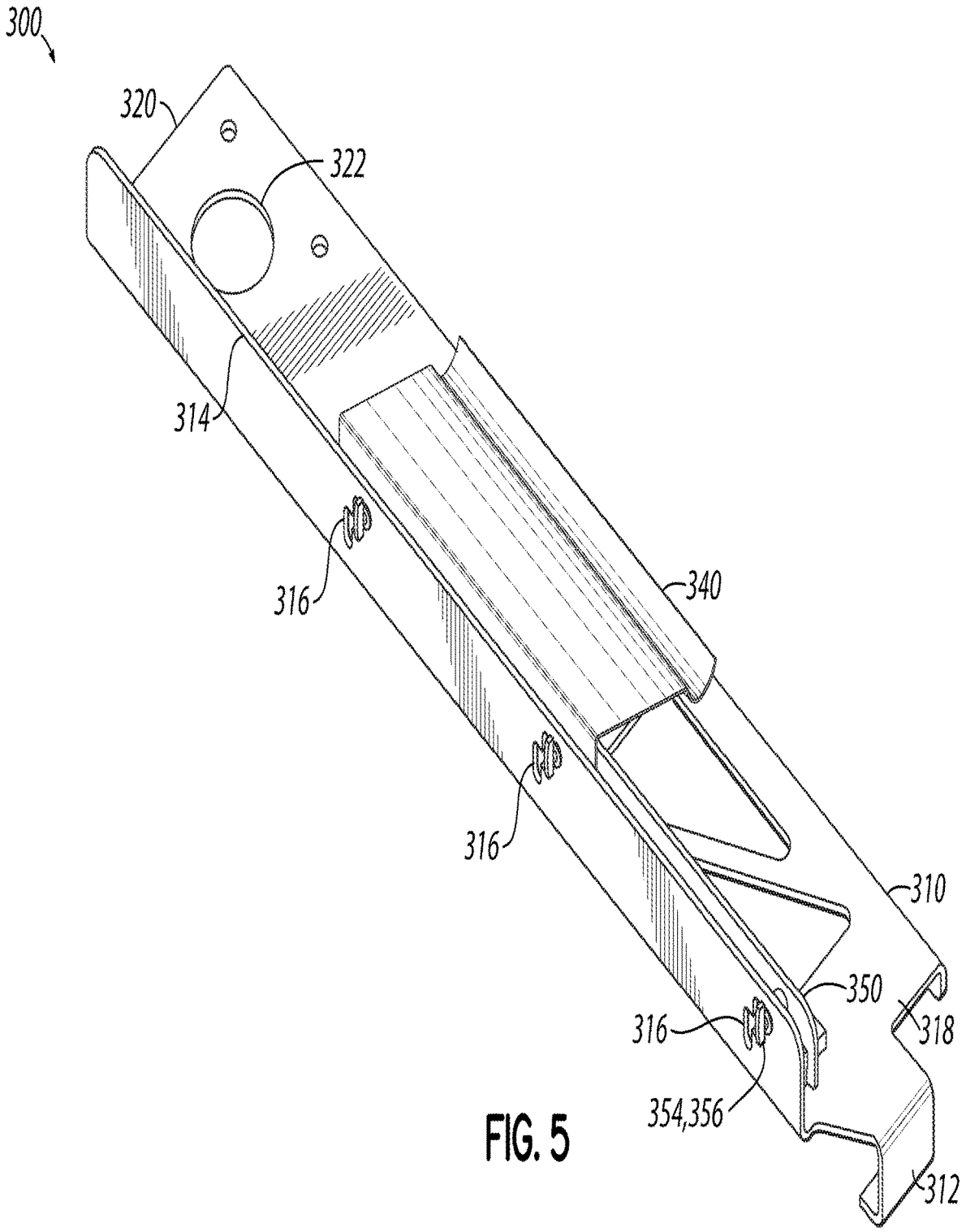
FIG. 5 is a detailed, side/top view of an illustrative throwing arm assembly.
Figure 6:
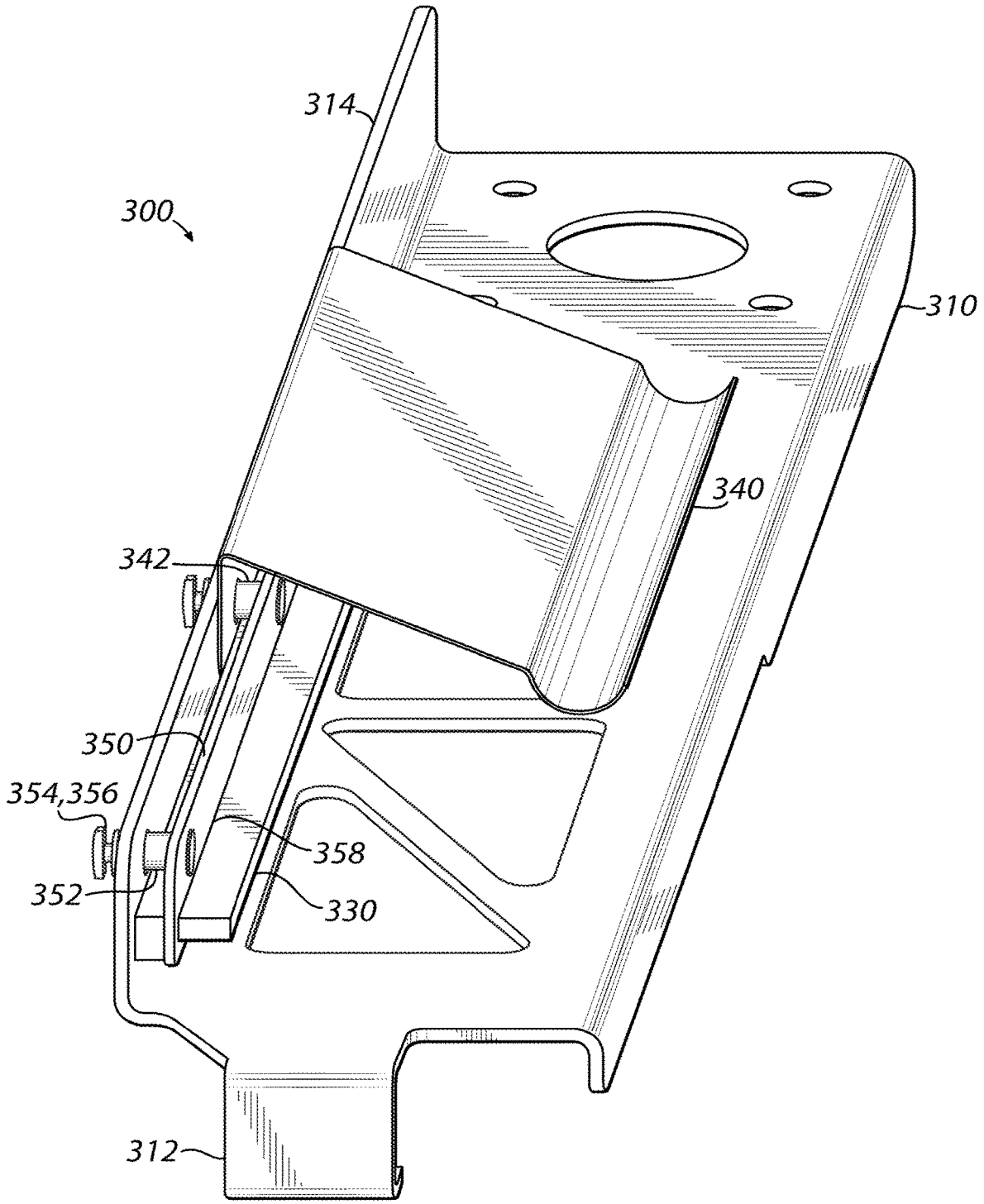
FIG. 6 is a detailed, top/rear view of an illustrative throwing arm assembly.

Referring to FIGS. 5 and 6, the illustrative throwing arm assembly 300 comprises a throwing arm 310, a flight guide 330, a clay spring plate 340, and a clay guide bracket 350. The throwing arm 310 further comprises a throwing arm catch 312, a throwing arm rail 314, a first end 318, a second end 320, and a plurality of mounting holes 322. In this illustrative example, the throwing arm rail 314 further comprises a plurality of stepped slots 316. The clay guide bracket 350 further comprises a plurality of threaded standoffs 352. In this illustrative example, the number of threaded standoffs 352 is equal to the number stepped slots 316. The clay spring plate 340 further comprises a plurality of holes 342 for locating and securing the clay spring plate 340. The clay guide bracket 350 further comprises a longitudinal slot 358. A portion of the flight guide 330 passes through the slot 358. In this illustrative example, the flight guide 330, clay spring plate 340 and clay guide bracket 350 are secured to the throwing arm 310 by means of a plurality of threaded fasteners 354. Utilizing the stepped slots 316, a user may selectively position one or more of the flight guide 330, clay spring plate 340 and clay guide bracket 350 relative to the throwing arm 310 without removing the threaded fasteners 354 in order to accommodate different sizes of target clays 150, for example. Additionally, the threaded fasteners 354 may be of a type, such as wing nuts or wing bolts, for example, allowing the user to adjust the position of one or more of the flight guide 330, clay spring plate 340 and clay guide bracket 350 relative to the throwing arm 310 without using tools.

Figure 7:
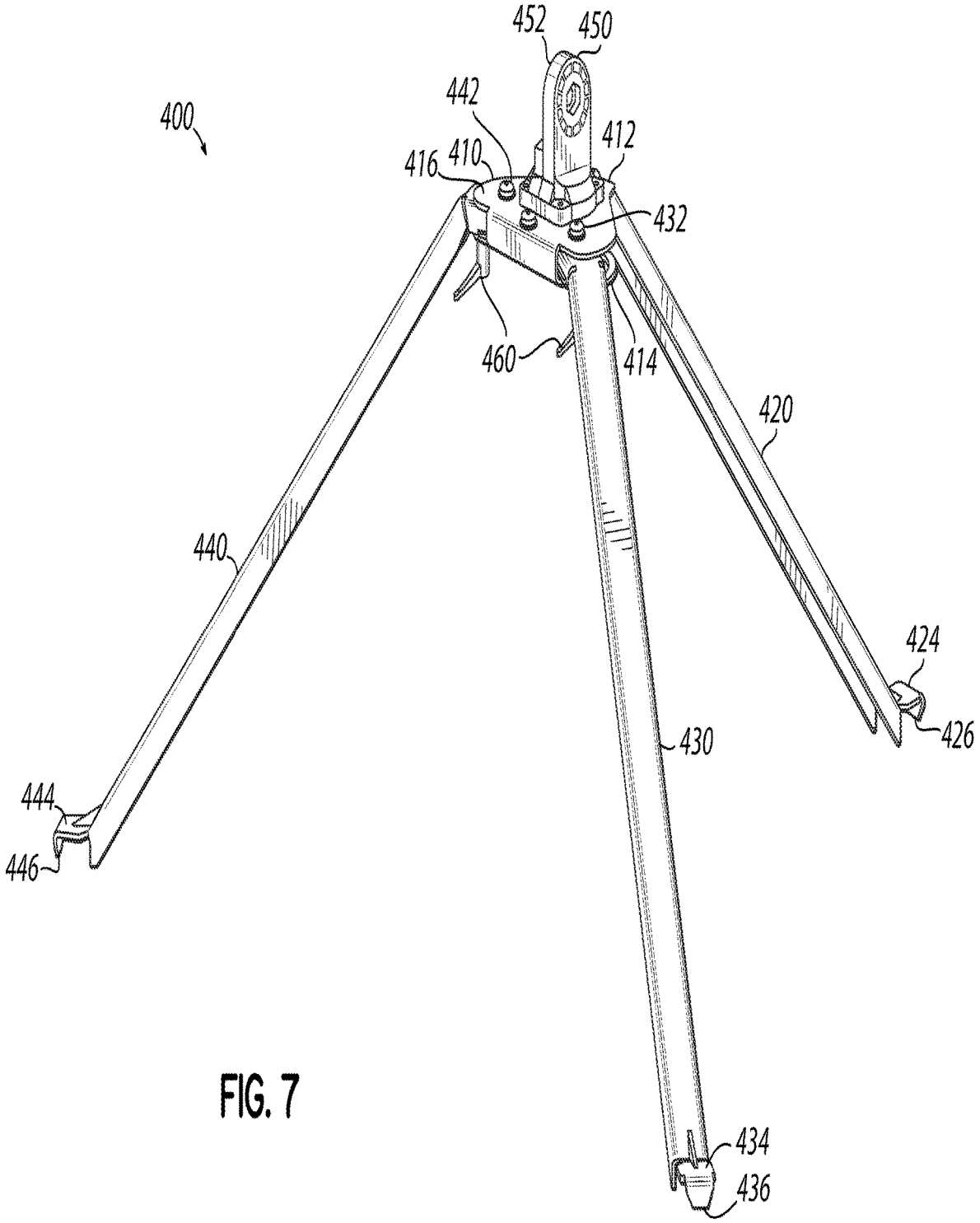
FIG. 7 is an elevation view of an illustrative base assembly.
Figure 8:
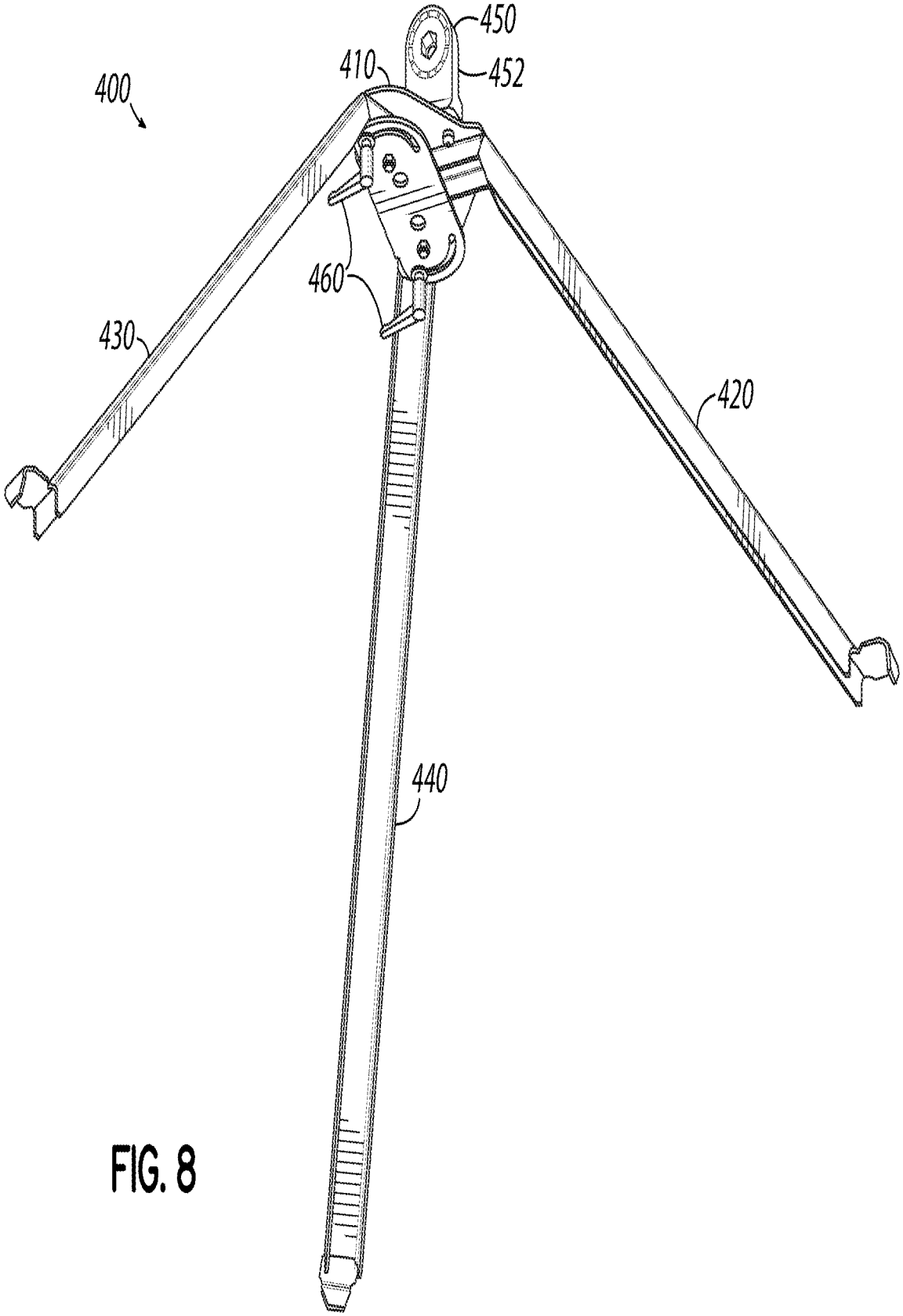
FIG. 8 is a bottom perspective view of an illustrative base assembly.

Referring to FIGS. 7 and 8, the illustrative base assembly 400 comprises a base 410, a front leg 420, a right rear leg 430, a left rear leg 440, a base pivot mount 450, and a plurality of leg adjustment levers 460. The base 410 further comprises a base front portion 412, a base right rear portion 414, and a base left rear portion 416. The front leg 420 is fixed to the base 410 proximate to the base front portion 412. The right rear leg 430 further comprises a right rear leg fastener 432. The left rear leg 440 further comprises a left rear leg fastener 442. The right rear leg 430 is rotatably attached to the base right rear portion 412 of the base 410 with the right rear leg fastener 432, with the right rear leg fastener 432 serving as the pivot point for the right rear leg 430. The left rear leg 440 is rotatably attached to the base left rear portion 414 of the base 410 with the left rear leg fastener 442, with the left rear leg fastener 442 serving as the pivot point for the left rear leg 440. The right rear leg 430 and the left rear leg 440 each have a leg adjustment lever 460 located proximity to the right rear leg fastener 432 and left rear leg fastener 442, respectively. The right rear leg 430 and the left rear leg 440 may be secured in a plurality of positions by a user with the leg adjustment levers 460. The base pivot mount 450 is attached to the top of the base 410. Using the leg adjustment levers 460, a user may position the right rear leg 430 and the left rear leg 440 without using tools.

In this illustrative example, the front leg 420 further comprises a foot 424 with one or more tabs and/or spikes 426. The right rear leg 430 further comprises a foot 434 with one or more tabs and/or spikes 436. The left rear leg 440 further comprises a foot 444 with one or more tabs and/or spikes 446. The tabs and/or spikes 426, 436, and 446 may dig into the ground or surface the clay target thrower 100 is placed upon and may prevent the clay target thrower 100 from moving or twisting during operation.

Figure 9:
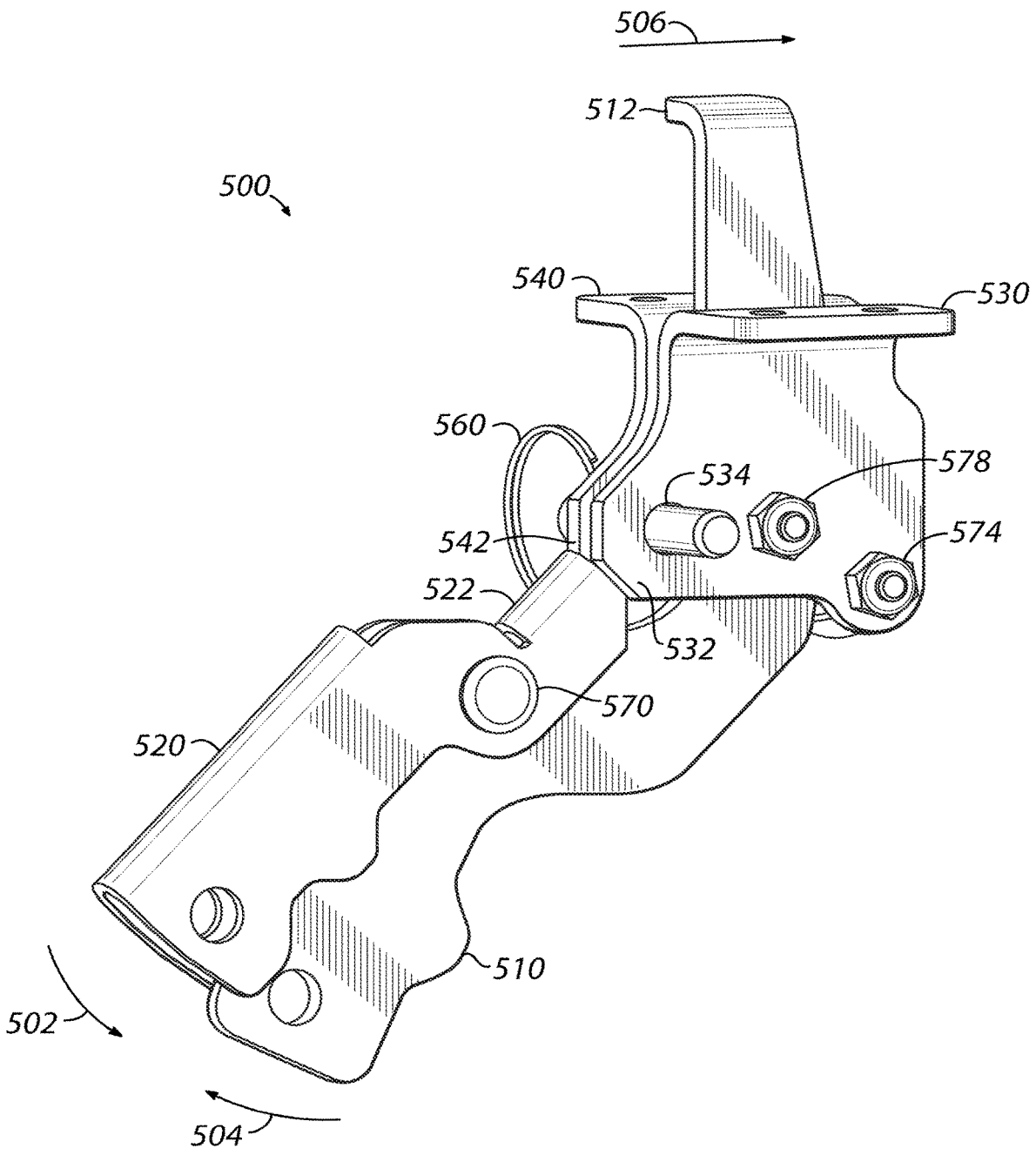
FIG. 9 is a detailed view of an illustrative trigger assembly.
Figure 10:
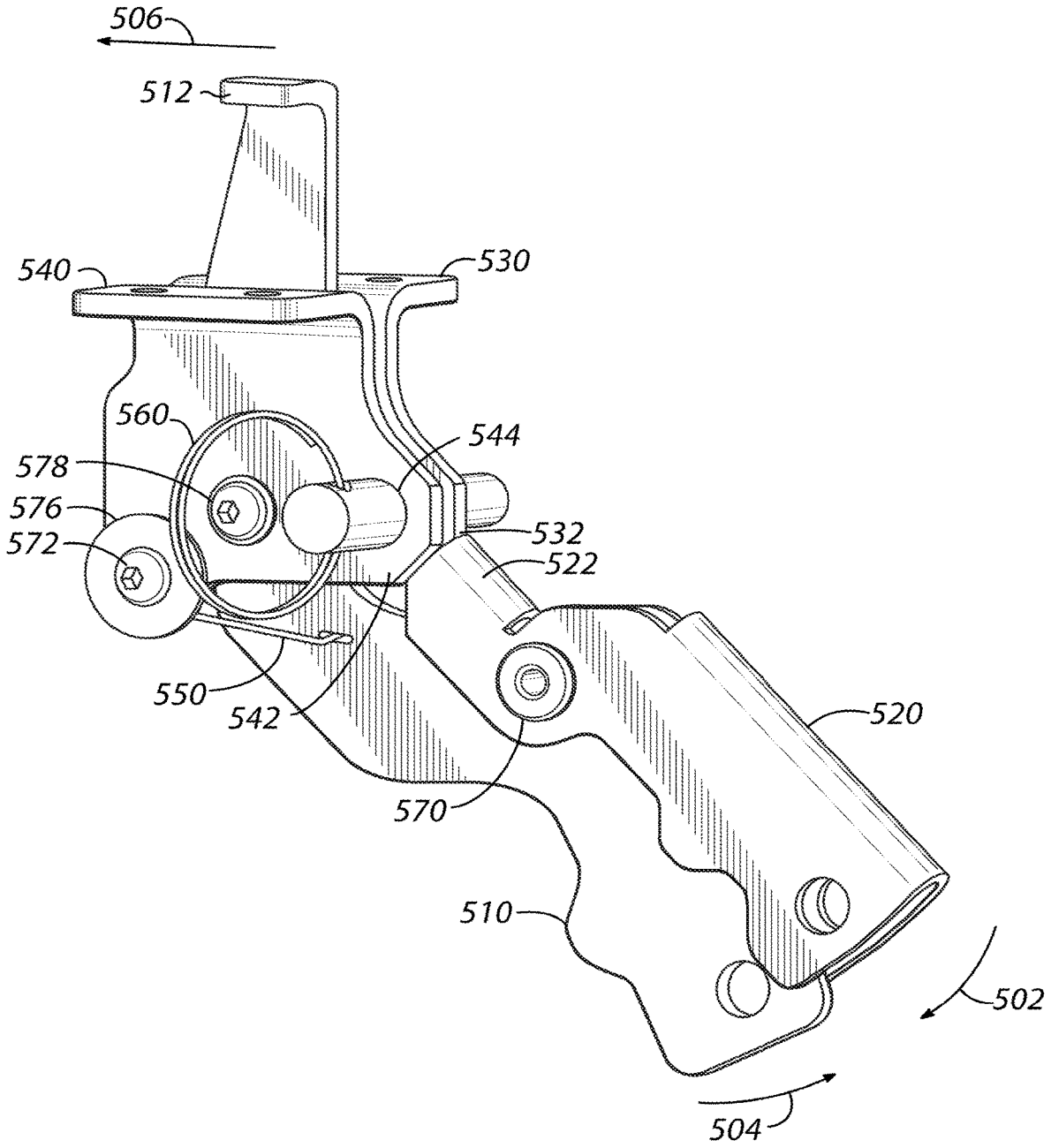
FIG. 10 is an alternate detailed view of an illustrative trigger assembly.

Referring to FIGS. 9 and 10, in this illustrative embodiment the trigger assembly 500 comprises a release trigger 510, a trigger lockout 520, a right trigger mount 530, a left trigger mount 540, a trigger spring 550, and a release mechanism lock in the form of a release pin 560. The release trigger 510 further comprises a trigger catch 512. The release trigger 510 is rotatably attached to the right trigger mount 530 and the left trigger mount 540 with a fastener 578. The trigger spring 550 is attached to the right trigger mount 530 and the release trigger 510 whereby the trigger spring 550 applies a force to the release trigger 510 which holds the release trigger 510 in a first position. The trigger lockout 520 is rotatably attached to the release trigger 510 with a fastener 570. The trigger lockout 520 is biased in a first position by a spring, for example. The right trigger mount 530 further comprises a trigger lockout portion 532 and a release pin hole 534. The left trigger mount 540 further comprises a trigger lockout portion 542 and a release pin hole 544. While the trigger lockout 520 is in the first position, a catch portion 522 of the trigger lockout 520 prevents the release trigger 510 from rotating while the catch portion 522 is in contact with the trigger lockout portions 532 and 542 of the trigger mounts 530 and 540 respectively. The trigger lockout 520 prevents operation of the release trigger 510. The release pin 560 is removably installed in the release pin holes 534 and 544 and when installed the release pin 560 prevents movement of the release trigger 510.

Figure 11:
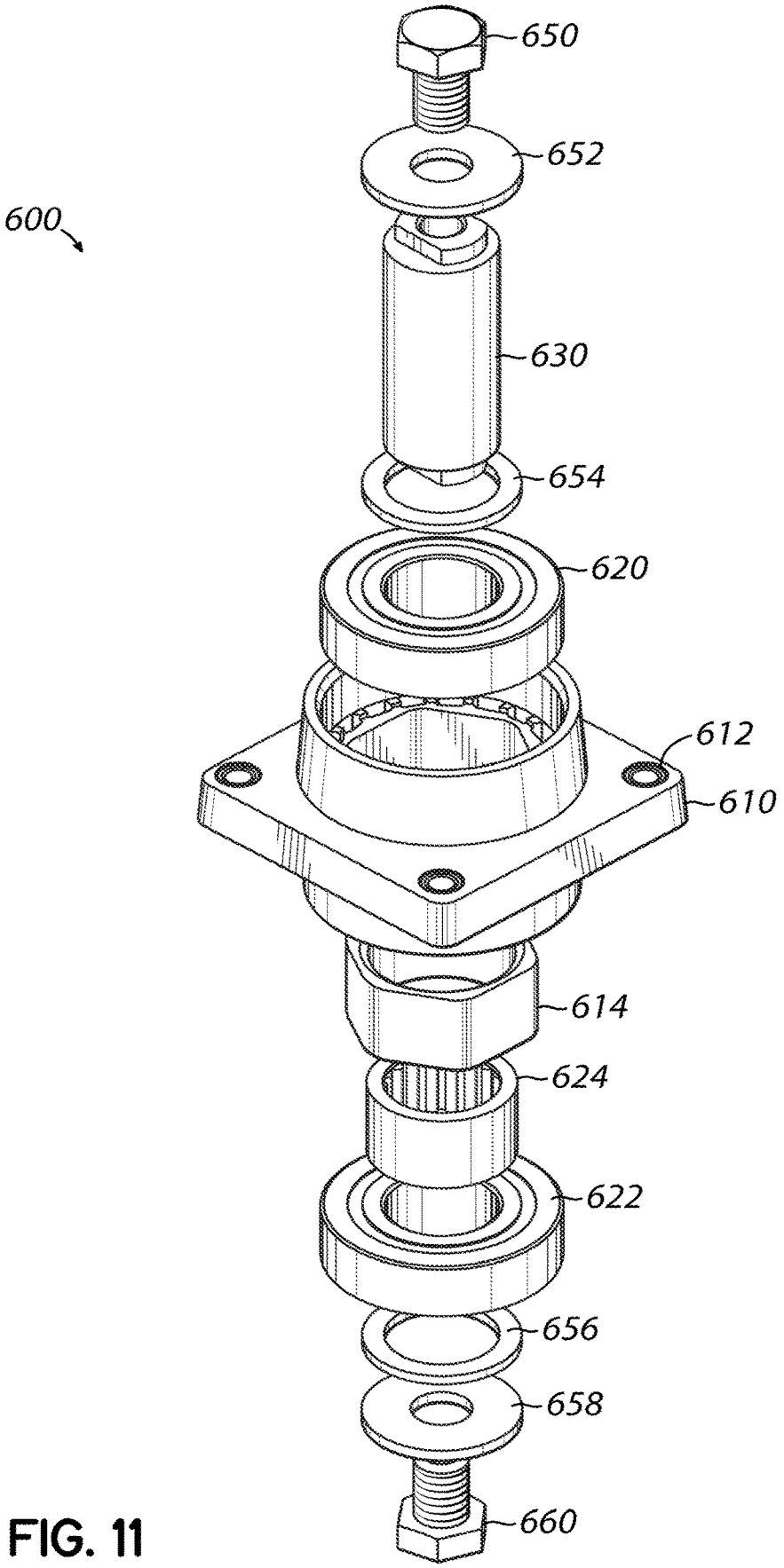
FIG. 11 is an exploded view of an illustrative bearing assembly.
Figure 12A:
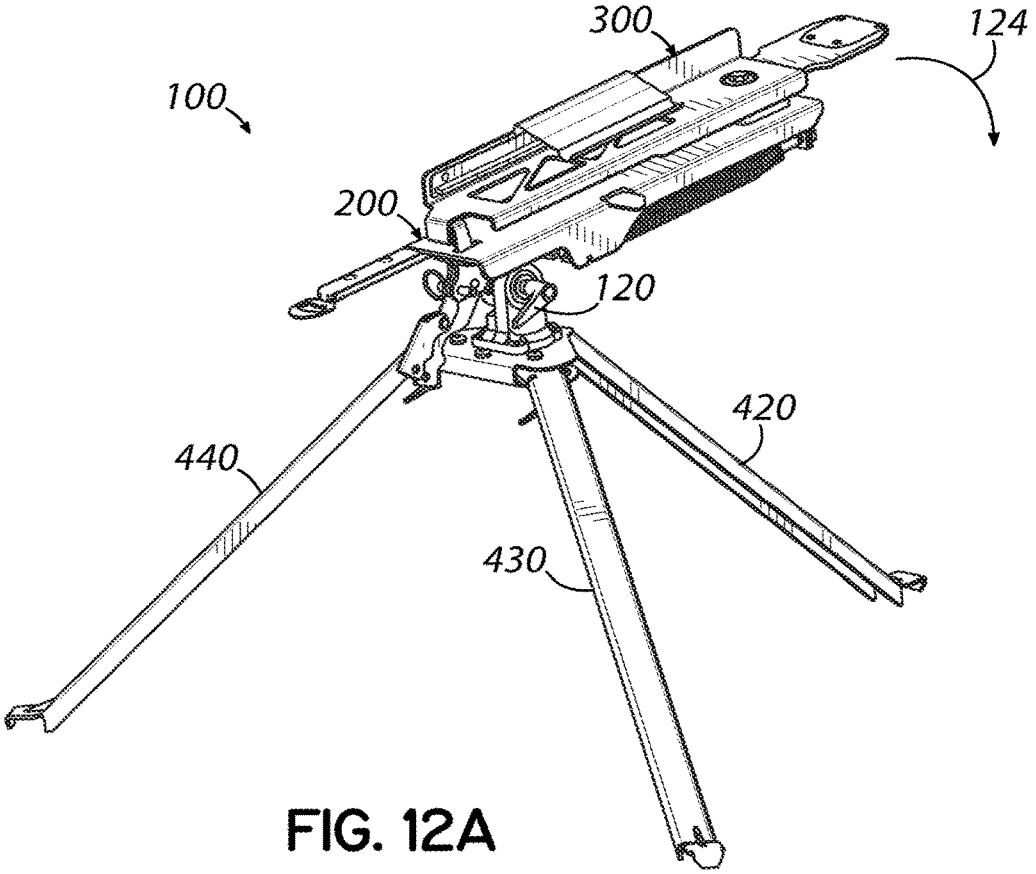
FIG. 12A is a perspective view of an illustrative clay target thrower being folded for transport and storage.
Figure 12B:
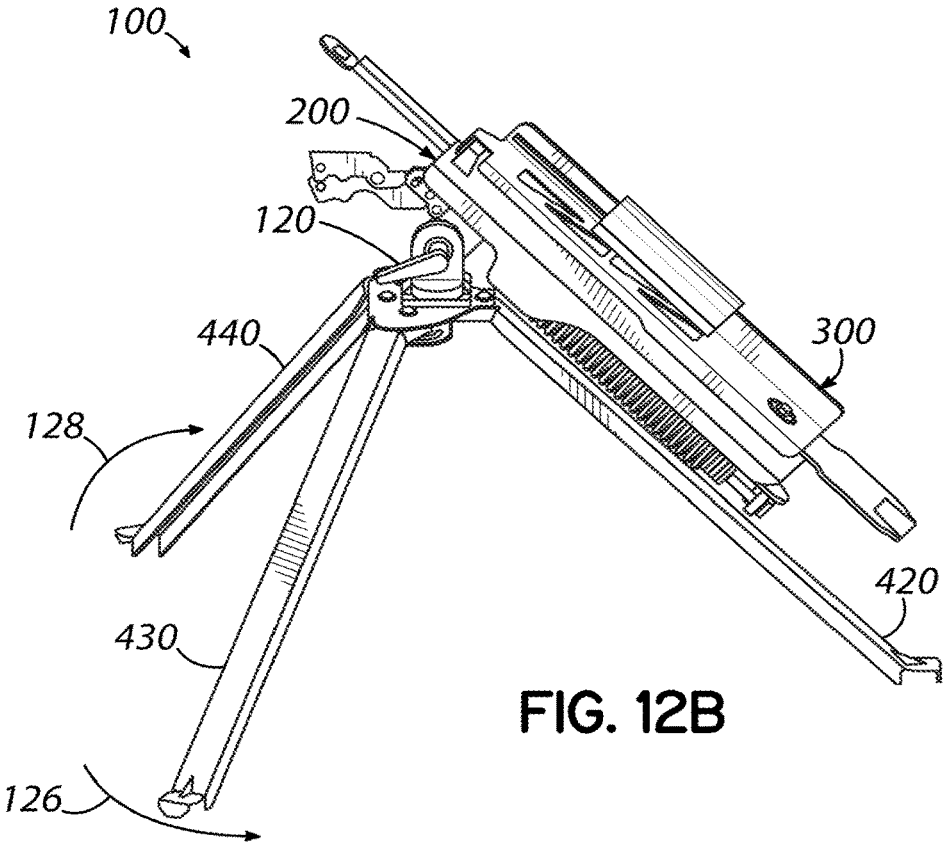
FIG. 12B is a perspective view of an illustrative clay target thrower being folded for transport and storage.
Figure 12C:
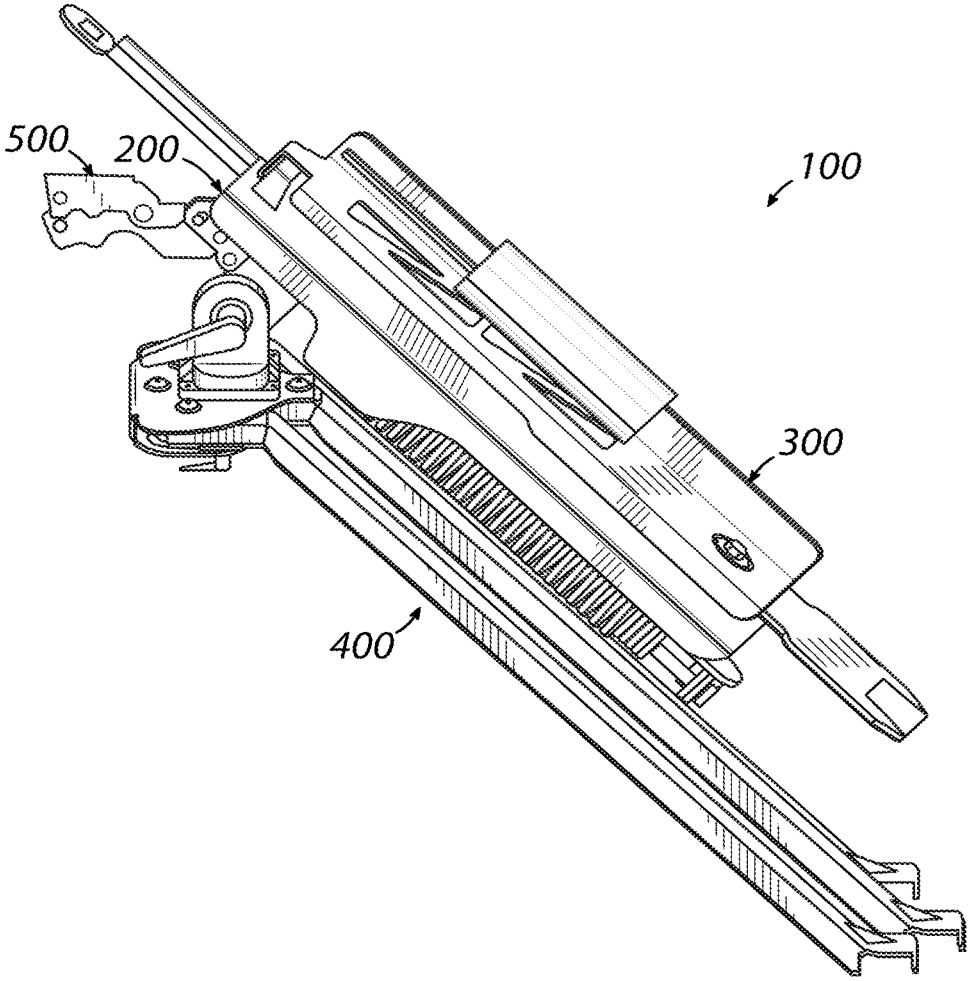
FIG. 12C is a perspective view of an illustrative clay target thrower folded for transport and storage.
Figure 13A:
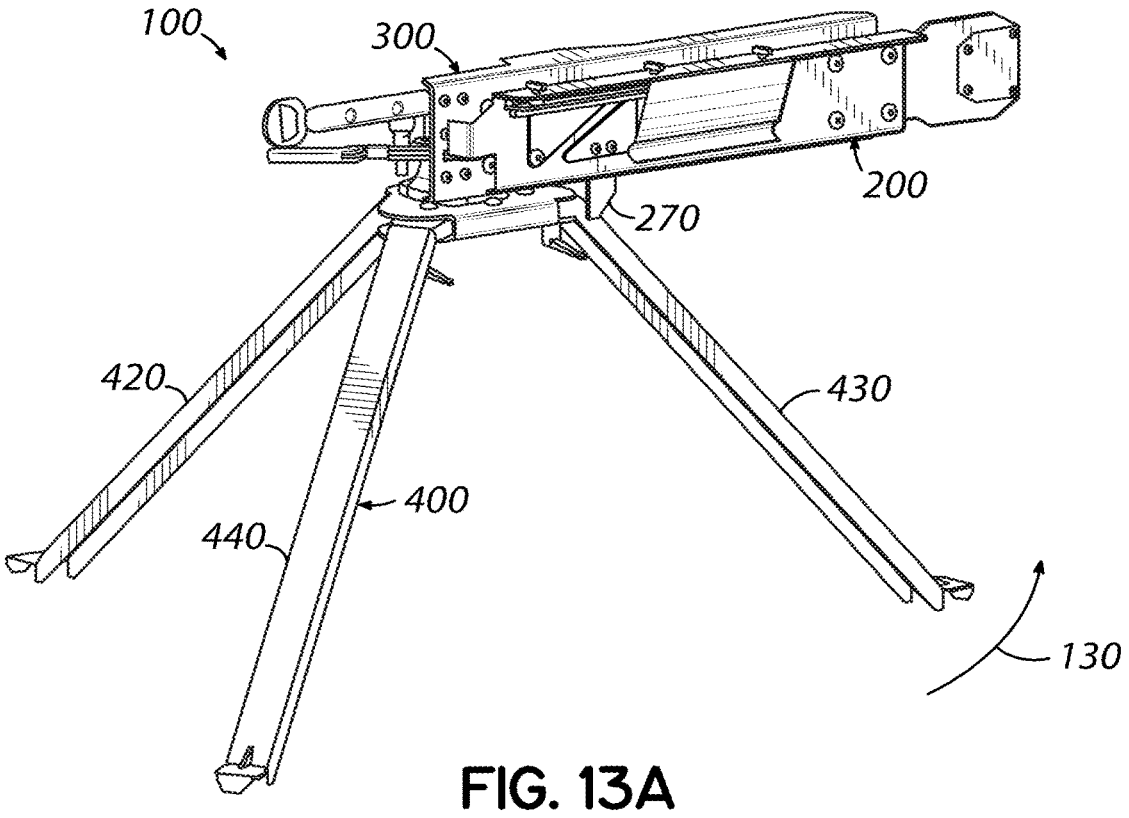
FIG. 13A is a perspective view of an illustrative clay target thrower configured to launch clay targets along the surface of the ground and/or just above the surface of the ground.
Figure 13B:
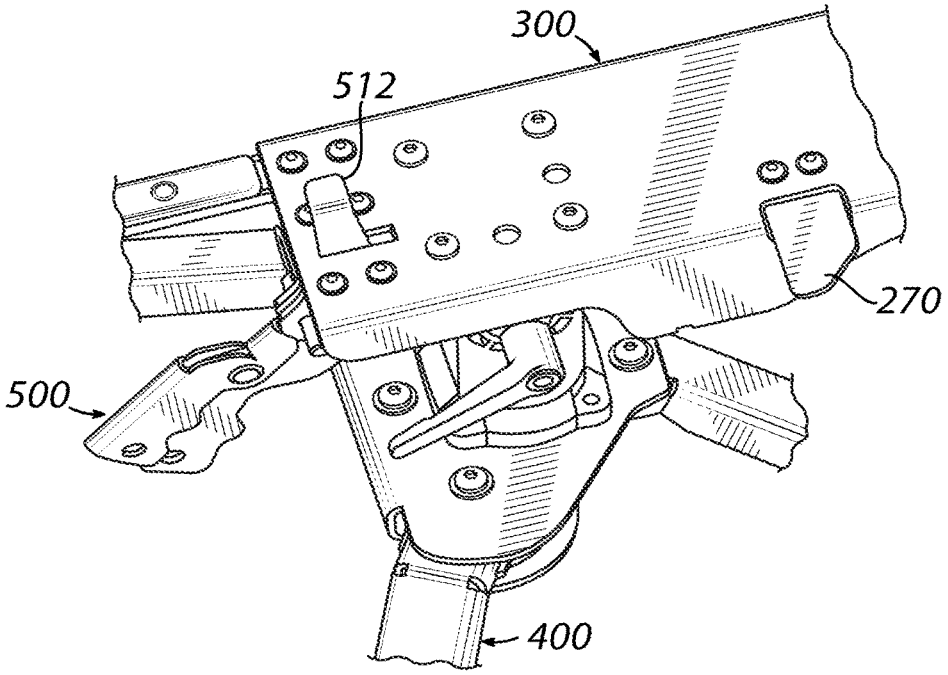
FIG. 13B is a detail view of an illustrative clay target thrower being configured to launch clay targets along the surface of the ground and/or just above the surface of the ground.
Figure 13C:
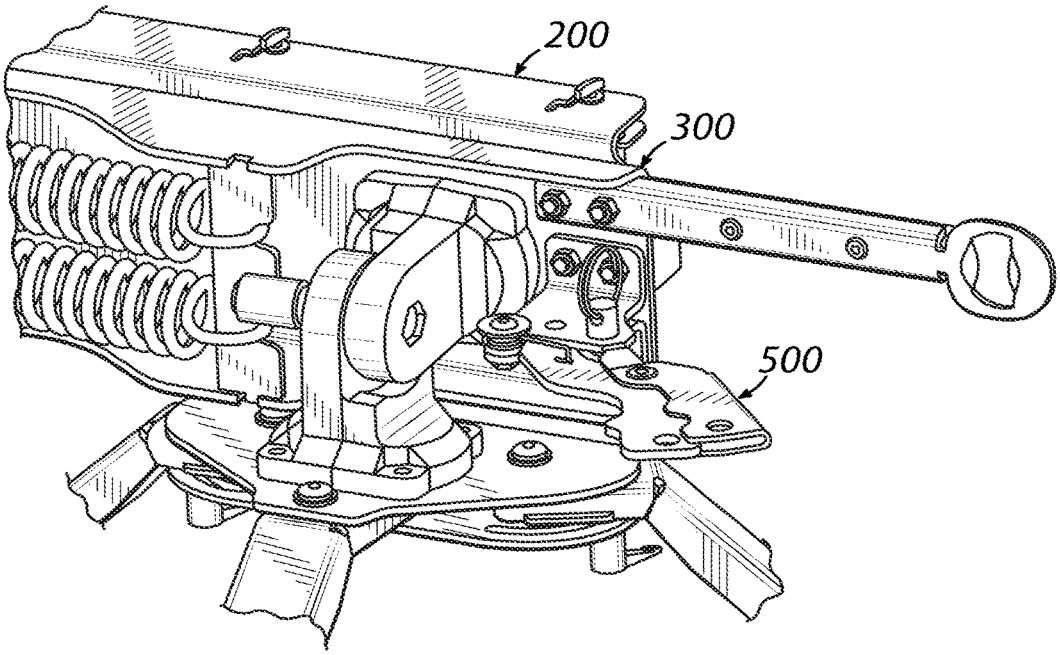
FIG. 13C is a detail view of an illustrative clay target thrower configured to launch clay targets along the surface of the ground and/or just above the surface of the ground.
Figure 13D:
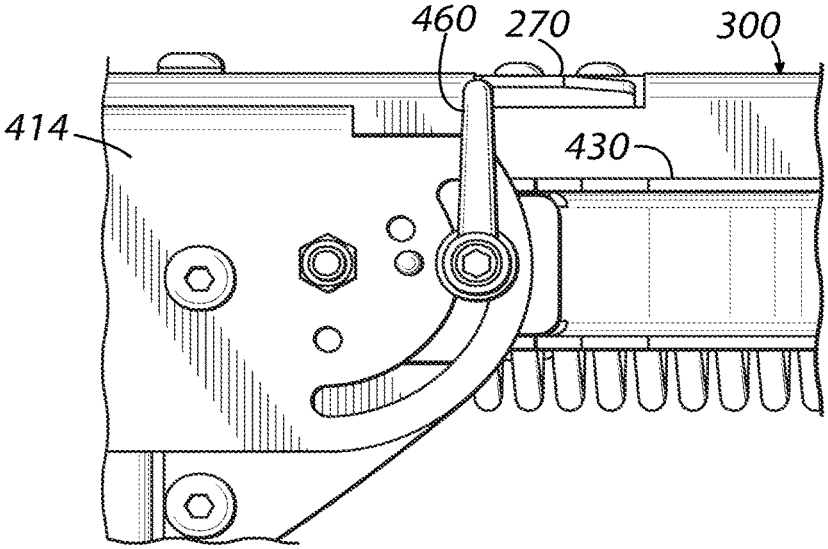
FIG. 13D is a detail view of an illustrative clay target thrower configured to launch clay targets along the surface of the ground and/or just above the surface of the ground.

Referring to FIG. 11, the illustrative clutch assembly 600 comprises a clutch housing 610, an upper bearing 620, a lower bearing 622, a one-way needle bearing 624, and a clutch shaft 630. The clutch housing 610 further comprises a plurality of threaded inserts 612 and a clutch housing bearing insert 614. The upper bearing 620 is installed above the clutch housing bearing insert 614 in the clutch housing 610 and the lower bearing 622 is installed below the clutch housing bearing insert 614 in the clutch housing 610. The one-way needle bearing 624 is installed in the clutch housing bearing insert 614 in the clutch housing 610. The clutch shaft 630 is installed through the centers of the upper bearing 620, the lower bearing 622, and the one-way needle bearing 624. The upper and lower bearings 620, 622 support the clutch shaft 630 and allow the clutch shaft 630 to rotate within the clutch housing 610, while the one-way needle bearing 624 limits the rotation of the clutch shaft 630 to a single direction.

Referring to FIGS. 4 and 11, in this illustrative embodiment, the lower bearing bracket 250 further comprises a lower bearing shaft 252. The lower bearing bracket 250 is mounted to the clutch shaft 630 such that the clutch shaft 630 rotates with the lower bearing bracket 250. The spring retainer bracket 260 is free to rotate within the spring retainer bracket 260.

Referring again to FIGS. 1 through 6, the second end 320 of the throwing arm assembly 300 is secured to the counterweight 240 on the support arm assembly 200. The springs 110 further comprise a spring hook 112 and a spring open end 114. The springs 110 are attached to the spring retainer plate 230 by the spring hooks 112. The spring open ends 114 are fastened to the spring retainer bracket 260 with spring fasteners 160, such as threaded screws and nuts, for example.

Referring to FIGS. 1 through 4, 7, and 8, the pivot mount adjustment lever 120 further comprises a shaft 122, such as a threaded screw, for example. The pivot mount adjustment lever 120 movably secures the support arm pivot mount 220 of the support arm assembly 200 to the base pivot mount 450 on the base assembly 400 with the shaft 122 passing through the support arm pivot mount 220 and the base pivot mount 450. The support arm pivot mount 220 further comprises a radially oriented toothed surface 222. The base pivot mount 450 further comprises a radially oriented toothed surface 452. When the pivot mount adjustment lever 120 is turned in a first direction, counterclockwise for example, the distal end 214 of the support arm assembly 220 and the second end 320 of the throwing arm assembly 300 may move generally vertically in the direction indicated by arrow 102. When the pivot mount adjustment lever 120 is turned in a second direction, clockwise for example, the support arm pivot mount 220 and the base pivot mount 450 may be drawn together whereby the toothed surfaces 222 and 452 may be selectively engaged thereby securing the vertical position of the support arm assembly 200 and the throwing arm assembly 300. The radially oriented toothed surfaces 222, 452 may allow for selective vertical angle adjustment of the clay target thrower 100, for example. The support arm pivot mount 220, the base pivot mount 450, and the pivot mount adjustment lever 120 together form a movable clay target thrower mount, for example. Using the pivot mount adjustment lever 120, a user may adjust the vertical angle of the throwing arm 310 relative to the base 410 without using tools, for example.

Referring to FIGS. 1 through 6, 9 and 10, in order to prepare the clay target thrower 100 for use, a user will rotate the throwing arm 310 counterclockwise until the throwing arm catch 312 of the throwing arm 300 engages the trigger catch 512 of the trigger assembly 500, also known as cocking the throwing arm 310. The trigger assembly 500, secures the throwing arm 310 in a ready position as shown in FIG. 1. After cocking the throwing arm 310, the user places one or more target clays 150 on the throwing arm 310, against the flight guide 330 and under the clay spring plate 340. The clay spring plate 340 holds the one or more target clays 150 against the throwing arm 310 until the throwing arm 310 is released to launch the one or more target clays 150. In order to launch the one or more target clays 150, a user operates the trigger assembly 500 to release the throwing arm 310.

In order to operate the trigger assembly 500 a user may apply a force to the trigger lockout 520 in the direction of arrow 502 moving the trigger lockout 520 in the direction indicated by arrow 502 relative to the release trigger 510 and into a second position. While the trigger lockout 520 is in the second position, the catch portion 522 of the trigger lockout 520 will be clear of the trigger lockout portions 532 and 542 allowing the release trigger 510 to rotate. Again, with the trigger lockout 520 in the second position, the user may apply a force to the release trigger 510 in the direction of arrow 504 moving the release trigger 510 in the direction of arrow 504 and into a second position and moving the trigger catch 512 in the direction of arrow 506. When the trigger catch 512 moves in the direction of arrow 506, the throwing arm catch 312 of the throwing arm 310 is released, allowing the throwing arm 310 to quickly rotate counterclockwise and launch the one or more target clays 150. The springs 110 provide a force required to quickly rotate the throwing arm 310 counterclockwise to launch the one or more target clays 150.

Removal of the forces on the trigger lockout 520 and the release trigger 510 will allow the trigger lockout 520 and the release trigger 510 to return to their respective first positions.

Referring to FIGS. 1, 2, and 12A through 12C, the illustrative clay target thrower 100 may be folded for transport and storage without using tools. In this illustrative example, the pivot mount adjustment lever 120 may be turned in a first direction, counterclockwise for example, allowing the support arm assembly 200 and the throwing arm assembly 300 to be rotated generally downward in the direction of arrow 124 such that the support arm assembly 200 is generally resting against the front leg 420. The pivot mount adjustment lever 120 may be turned in a second direction, clockwise for example, securing the support arm assembly 200 generally against the front leg 420. The right rear leg 430 may be rotated generally counterclockwise in the direction of arrow 126 to a position generally parallel to the front leg 420 by turning the adjustment lever 460 in a first direction, counterclockwise for example, allowing the right rear leg 430 to rotate. Once the right rear leg 430 is in a position generally parallel to the front leg 420, the adjustment lever 460 may be turned in a second direction, clockwise for example, securing the right rear leg 430 is in a position generally parallel to the front leg 420. The left rear leg 440 may be rotated generally clockwise in the direction of arrow 128 to a position generally parallel to the front leg 420 by turning the adjustment lever 460 in a first direction, counterclockwise for example, allowing the left rear leg 440 to rotate. Once the left rear leg 440 is in a position generally parallel to the front leg 420, the adjustment lever 460 may be turned in a second direction, clockwise for example, securing the left rear leg 440 is in a position generally parallel to the front leg 420. The folded configuration shown in FIG. 12C may allow for easier transport and/or storage of the clay target thrower 100. The support arm pivot mount 220, the base pivot mount 450, and the pivot mount adjustment lever 120 together form a mechanism wherein the clay target thrower 100 is configurable between the operational position and a folded position shown in FIG. 12C without using tools.

Referring to FIGS. 1 through 4, 7, 8, and 13A through 13D, the clay target thrower 100 may be configured to one or more clay targets 150 along the surface of the ground and/or just above the surface of the ground. A user may remove support arm 210 from the support arm pivot mount 220 and re-install the support arm 210 to the support arm pivot mount 220 in an orientation 90 degrees clockwise from the original support arm 210 orientation. The right rear leg 430 may then be rotated generally counterclockwise in the direction of arrow 130 to a position generally parallel to the support arm 210 by turning the adjustment lever 460 in a first direction, counterclockwise for example, allowing the right rear leg 430 to rotate. Once the right rear leg 430 is in a position generally parallel to the support arm 210, the adjustment lever 460 may be turned in a second direction, clockwise for example, securing the right rear leg 430 is in a position generally parallel to the support arm 210. The user may then loosen the pivot mount adjustment lever 120 and rotate the support arm assembly 200 and the throwing arm assembly 300 as shown by arrow 106 until the top surfaces of the support arm assembly 200 and the throwing arm assembly 300 are generally perpendicular to the ground. The rabbit plate 270 ensures the right rear leg 430 is properly positioned to prevent the throwing arm assembly 300 from striking the right rear leg 430 when the clay target thrower 100 is operated.

Figure 14:
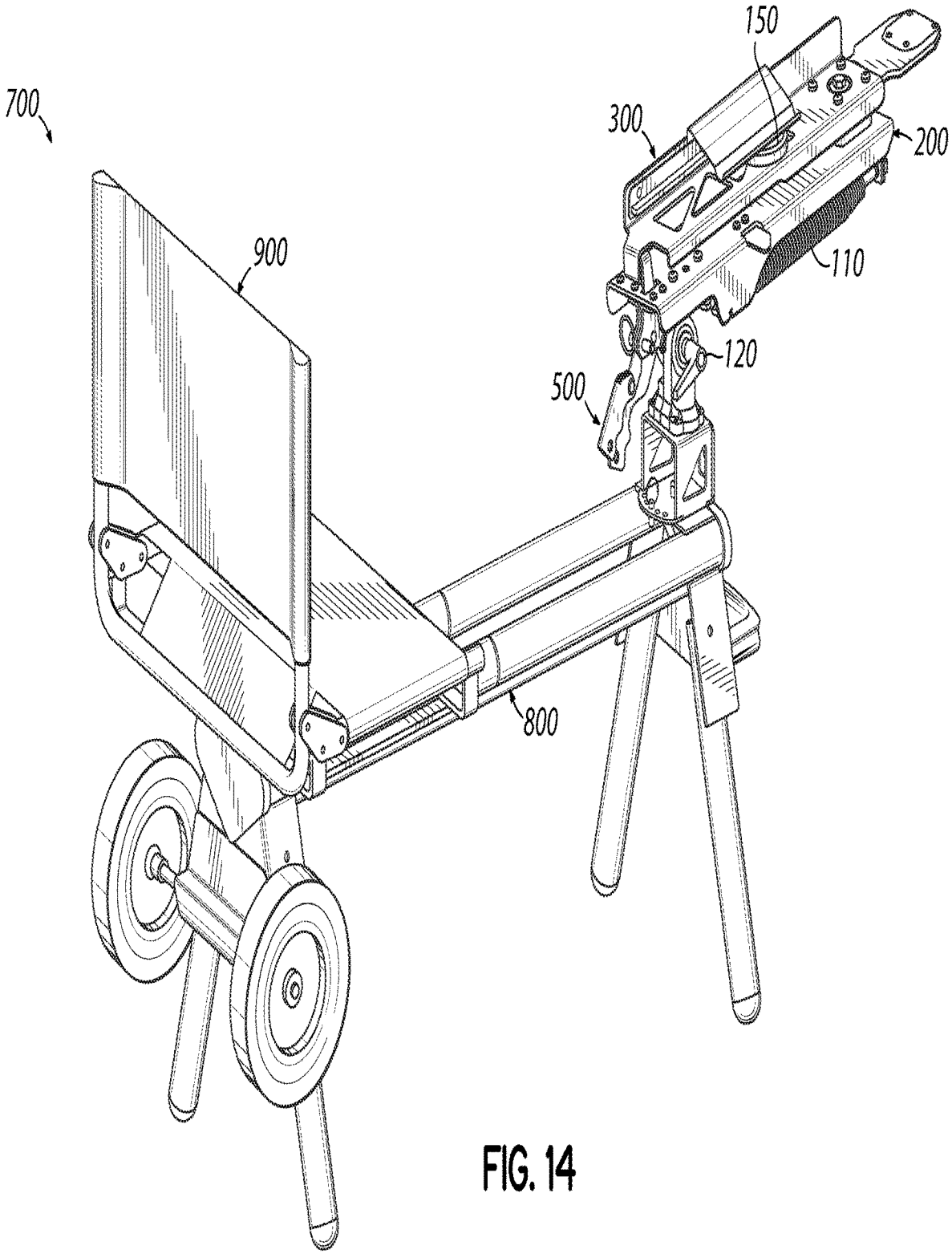
FIG. 14 is a perspective view of an alternate illustrative clay target thrower.
Figure 15:
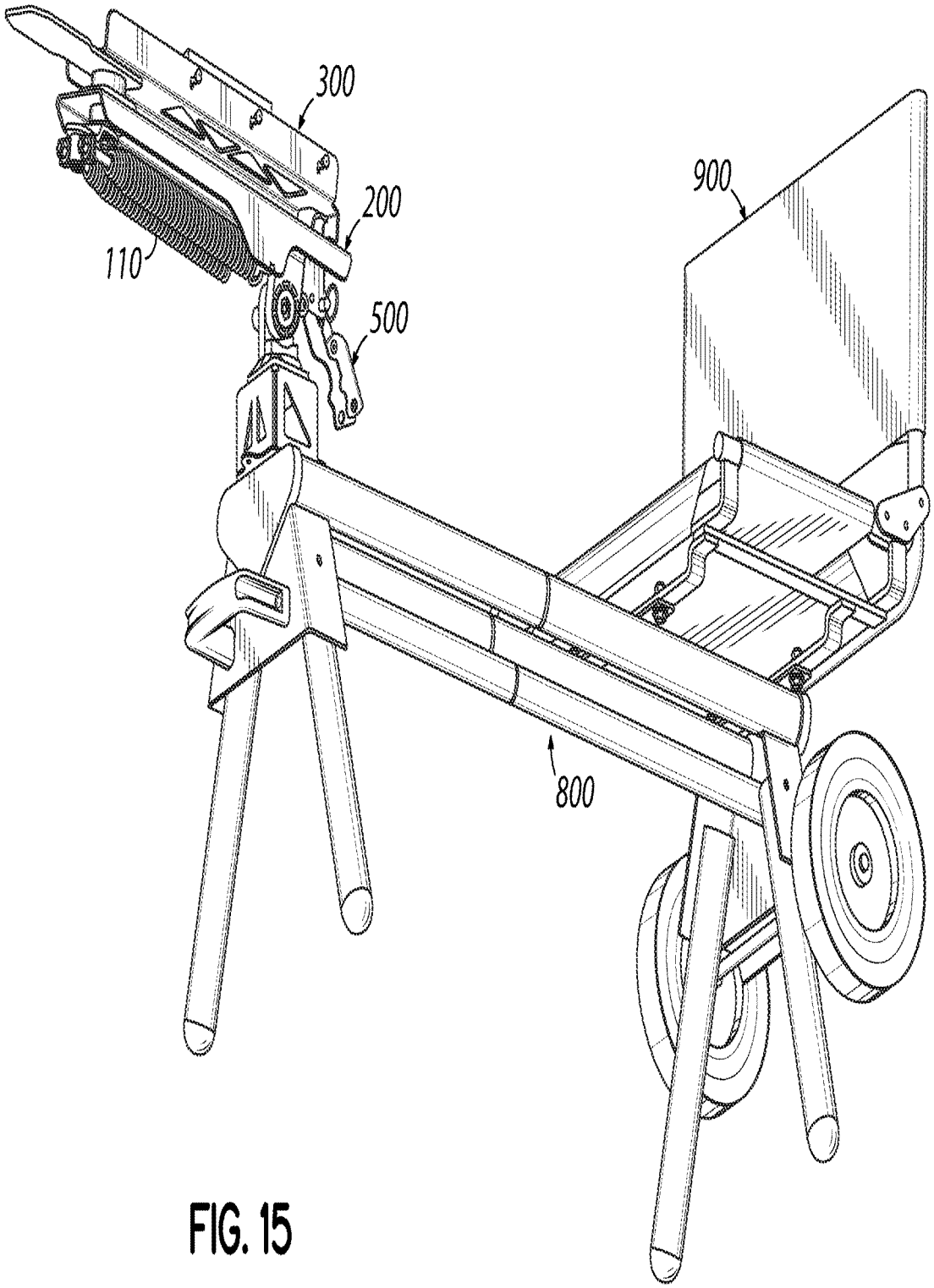
FIG. 15 is an alternate perspective view of an alternate illustrative clay target thrower.

Referring to FIGS. 14 and 15, an illustrative alternative clay target thrower 700 comprises a support arm assembly 200, a throwing arm assembly 300, a trigger assembly 500 a base assembly 800, and a seat assembly 900. The illustrative clay target thrower 700 further comprises two springs 110, and a pivot mount adjustment lever 120. The clay target thrower 700 may be operated by a user to launch one or more target clays 150. The clay target thrower 700 shares a significant number of components with the clay target thrower 100 described previously. Like components will use the same figures and component numbering for ease of reference Like components have the same functionality as described previously. The user seat 900 is generally where a user would be located to operate the clay target thrower 700.

Figure 16:
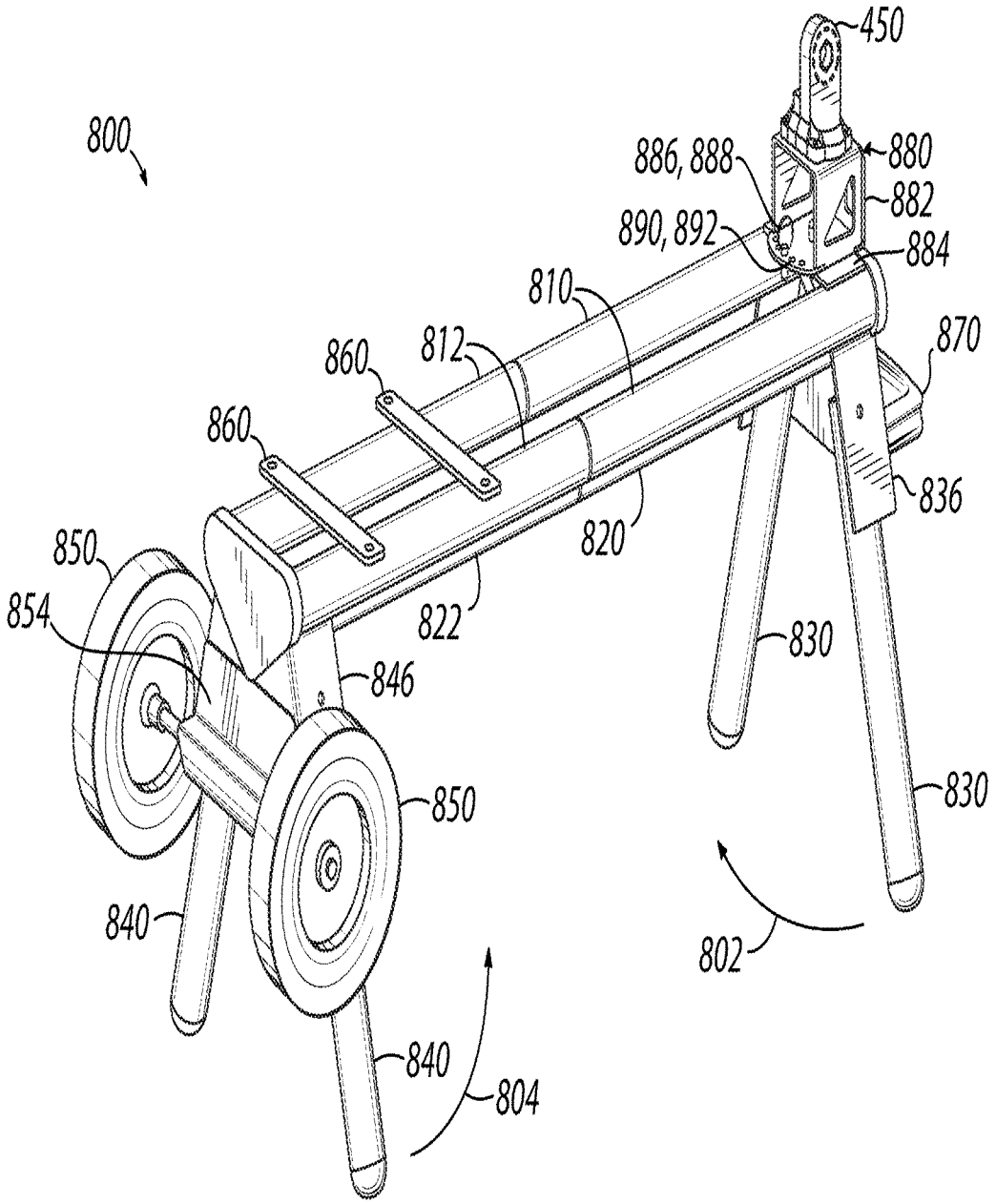
FIG. 16 is an elevation view of an alternate illustrative base assembly.
Figure 17:
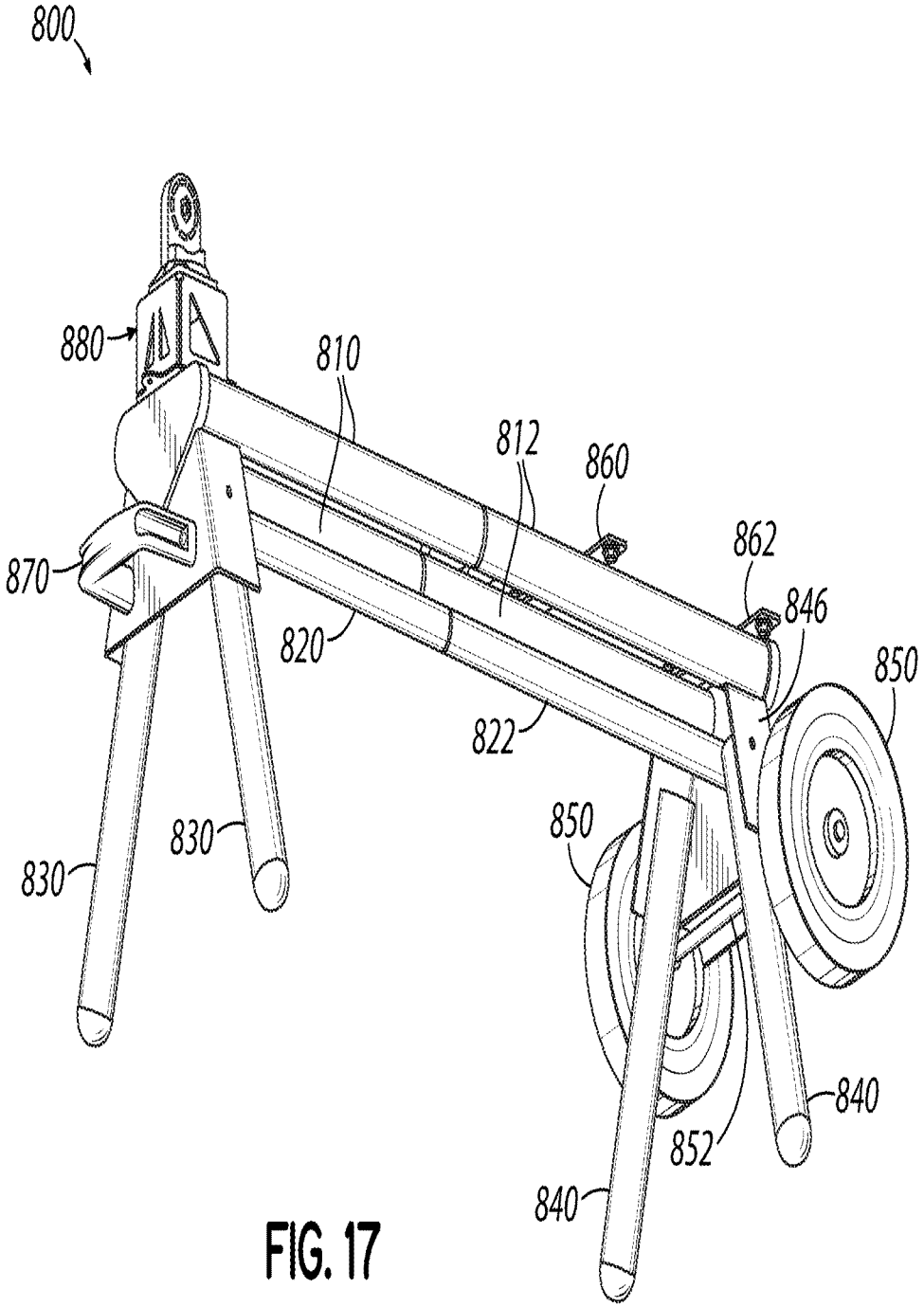
FIG. 17 is a bottom perspective view of an alternate illustrative base assembly.
Figure 18:
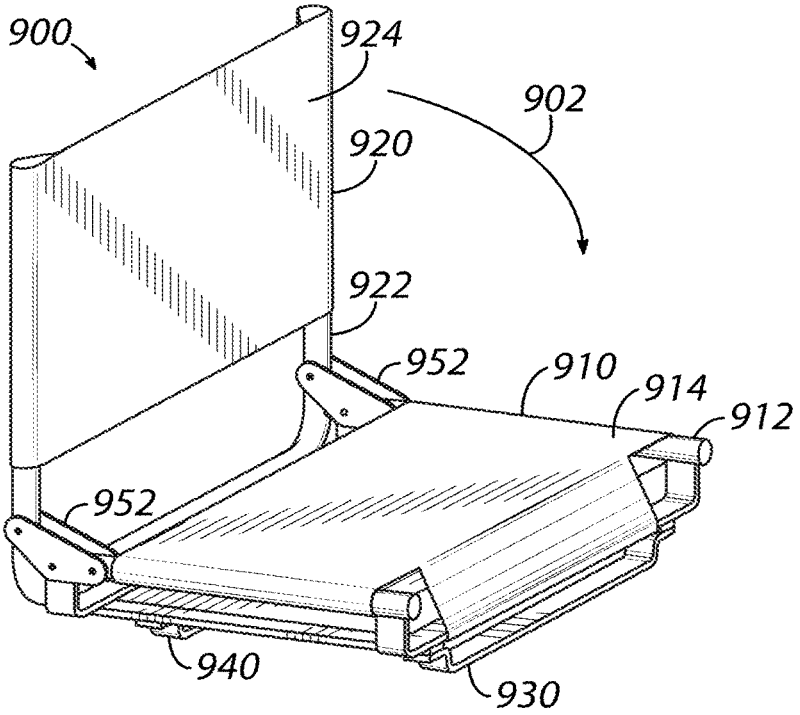
FIG. 18 is a detailed view of an illustrative user seat.
Figure 19:
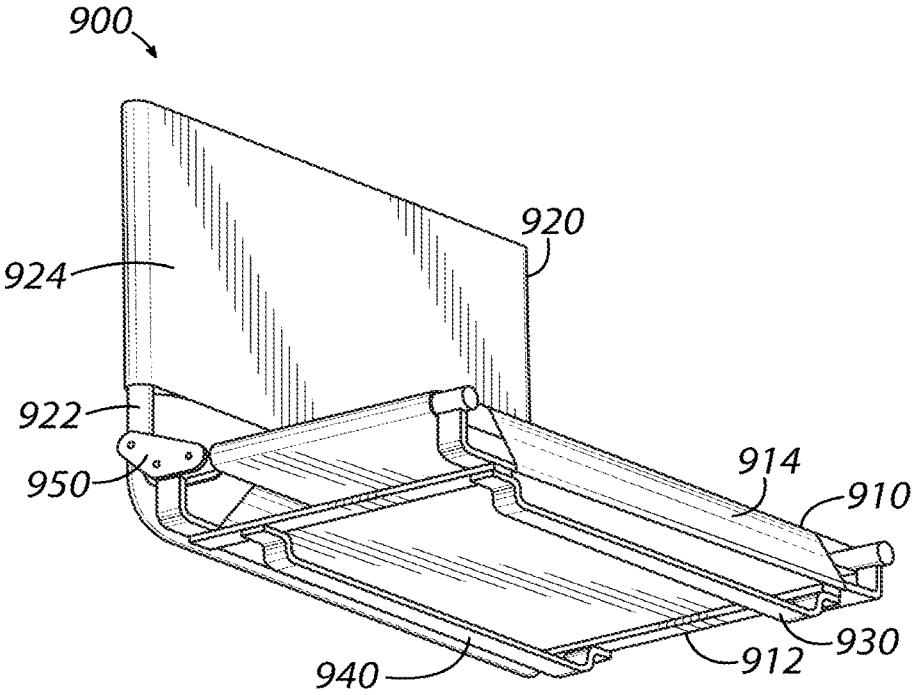
FIG. 19 is an alternate detailed view of an illustrative user seat.
Figure 20A:
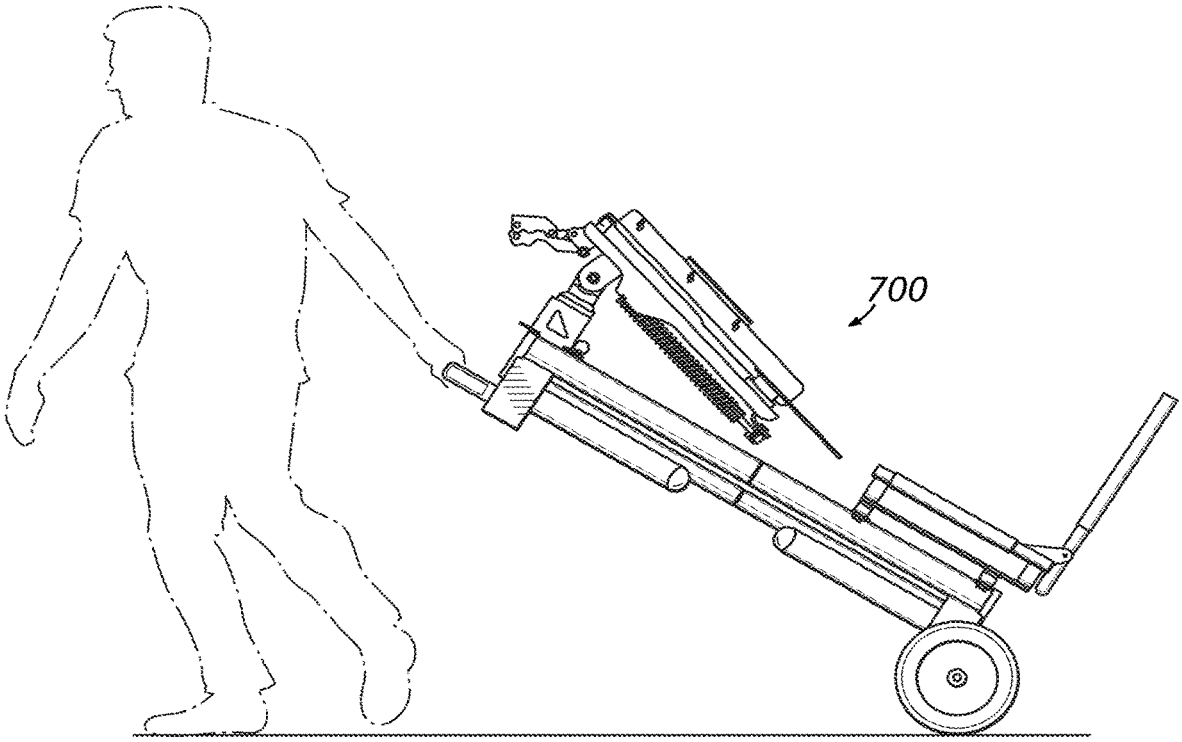
FIG. 20A is a perspective view of an alternate illustrative clay target thrower folded for transport.
Figure 20B:
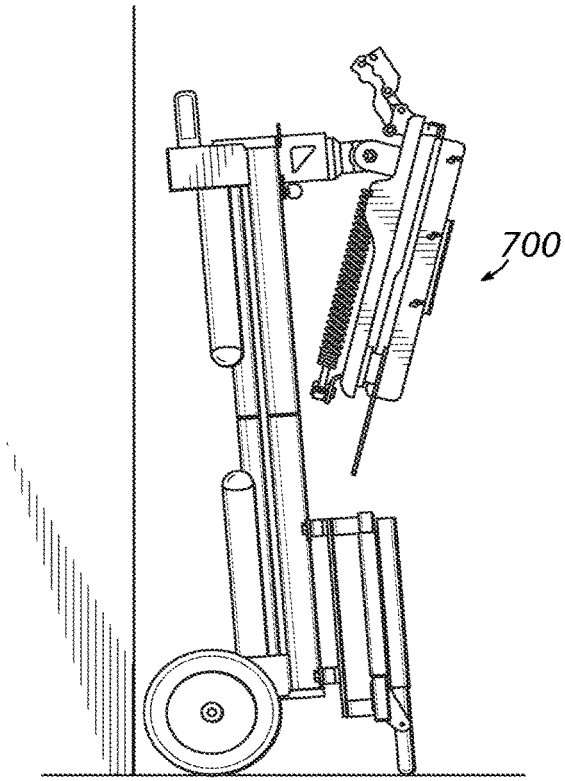
FIG. 20B is a perspective view of an alternate illustrative clay target thrower folded for storage.

Referring to FIGS. 16 and 17, the illustrative base assembly 800 comprises two top front tubes 810, two top rear tubes 812, a bottom front tube 820, a bottom rear tube 822, two front legs 830, a front leg mounting bracket 836, two rear legs 840, a rear leg mounting bracket 846, two wheels 850, a front seat mounting bracket 860, a rear seat mounting bracket 862, a handle 870, a pivot mount bracket assembly 880, and a base pivot mount 450. The front legs 830 are rotatably attached to the front leg mounting bracket 836. The rear legs 840 are rotatably attached to the rear leg mounting bracket 846. The two wheels 850 are rotatably attached to an axle 852. The axle 852 is mounted to a wheel bracket 854. The wheel bracket 854 is attached to the rear leg mounting bracket 846.

In this illustrative embodiment, the front legs 830 and the rear legs 840 may be positioned for transport and storage. In some embodiments the front legs 830 and the rear legs 840 may be positioned for transport and storage without using tools. A user may rotate the front legs 830 generally in the direction indicated by arrow 802 until the front legs 830 are generally parallel to the front tubes 810 and 820. Similarly, a user may rotate the rear legs 840 generally in the direction indicated by arrow 804 until the rear legs 840 are generally parallel to the rear tubes 812 and 822. When the front and rear legs 830 and 840 are positioned for transport and storage, a user may use the handle 870 and the wheels 850 to move the clay target thrower 700, similar to the way a user would move a two-wheel hand truck or dolly, for example.

The pivot mount block assembly 880 comprises a pivot mount block 882, a mounting plate 884, and a locating pin 886. A base pivot mount 450 for mounting the support arm assembly 200 is attached to the top of the pivot mount bracket 882. The mounting plate 884 is attached to the front tubes 810. The pivot mount block 882 is rotatably attached to the mounting plate 884. The mounting plate 884 further comprises a locating pin hole 890. The pivot mount block 882 further comprises a plurality of locating pin holes 892 arranged in an arc such that if the pivot mount block 882 is rotated, individual locating pin holes 892 will align with the locating pin hole 890 in the mounting plate 884. The locating pin 886 further comprises a lanyard 888 which may be attached to the base assembly 800 to prevent loss of the locating pin 886, for example.

Referring to FIGS. 14 through 17, in this illustrative embodiment, the horizontal position of the support arm assembly 200 and the throwing arm assembly 300 may be adjusted relative to the base assembly 800. A user may adjust the horizontal position of the support arm assembly 200 and the throwing arm assembly 300 by rotating the support arm assembly 200 and the throwing arm assembly 300 causing the pivot mount block 882 to rotate on the mounting plate 884. A user may align one of the locating pin holes 892 in the pivot mount block 882 with the locating pin hole 890 in the mounting plate 884. With the holes 890 and 892 aligned, the user may install the locating pin 886 through the holes 890 and 892 thereby securing the support arm assembly 200 and the throwing arm assembly 300 in the user desired position without using tools.

Referring to FIGS. 18 through 20B, the illustrative seat assembly 900 comprises a seat bottom 910, a seat back 920, a front seat mounting bracket 930, a rear seat mounting bracket 940, a right seat back hinge 950, and a left seat back hinge 952. The seat bottom 910 further comprises a seat bottom frame 912 and a fabric seat bottom cover 914. The front seat mounting bracket 930 is attached to the front of the seat bottom frame 912. The rear seat mounting bracket 940 is attached to the rear of the seat bottom frame 912. The right seat back hinge 950 and the left seat back hinge 952 are attached to the rear of the seat bottom frame 912. The seat back 920 further comprises a seat back frame 922 and a fabric seat back cover 924. The seat back frame 922 is movably attached to the right seat back hinge 950 and the left seat back hinge 952. The seat back 920 may be folded flat against the seat bottom 910 by a user by moving the seat back 920 in the general direction of arrow 902. By folding the seat back 920 flat against the seat bottom 910 the user seat assembly 900 may be made more compact for transport and/or storage, see FIG. 20B. The seat assembly 900 may be configured to retain any desired items, such as at least one of an ice chest, a clay target box, a gun case, and an ammunition box for transport, for example.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination within and between the various embodiments. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A device for launching at least one clay target comprising:

a manually-operated clay target thrower;

a seat coupled to the manually-operated clay target thrower, the seat configured for a user to be seated and manually cock the clay target thrower;

at least three support legs coupled to the manually-operated clay target thrower that stabilize the manually-operated clay target thrower when it is being manually cocked;

at least two wheels coupled to the manually-operated clay target thrower, wherein the wheels facilitate transporting the device; and at least one handle coupled to the manually-operated clay target thrower, the at least one handle on a side of the device opposite the at least two wheels that facilitates transporting the device.

2. The device of claim 1, wherein at least one of the at least three support legs is movable for transport and storage.

3. The device of claim 2 wherein at least one of the at least three legs is movable without using tools.

4. The device of claim 1, wherein the seat has an operation and transport open position and a folded position for transport.

5. The device of claim 4, wherein the seat is configured to retain and or transport at least one of an ice chest, a clay target box, a gun case, and an ammunition box.

6. A device for launching at least one clay target comprising:

a manually-operated clay target thrower;

a seat coupled to the manually-operated clay target thrower, the seat configured for a user to be seated and manually cock the clay target thrower, wherein the seat has an operation and transport open position and a folded position for transport and wherein the seat is configured to retain and or transport at least one of an ice chest, a clay target box, a gun case, and an ammunition box;

at least two support legs coupled to the manually-operated clay target thrower; and at least two wheels coupled to the manually-operated clay target thrower, wherein the wheels facilitate transporting the device.

* * * * *